US006094550A

United States Patent [19]

Kido et al.

[11] Patent Number: 6,094,550

[45] Date of Patent: Jul. 25, 2000

[54] DEVELOPING APPARATUS

[75] Inventors: Eiichi Kido, Yamatokoriyama; Shigeyuki Wakada; Toshihide Ohgoshi, both of Nara; Yoshinori Ohtsuka, Tenri; Hiroshige Araki, Yamatokoriyama; Yasuo Imai, Nara; Hiroshi Ishii, Kashihara; Yuhi Yui, Nabari, all of Japan

[73] Assignee: Sharp Kabushiki Kaisha, Osaka, Japan

[21] Appl. No.: 09/084,414

[22] Filed: May 27, 1998

[30] Foreign Application Priority Data

| | | | |
|---|---|---|---|
| May 27, 1997 | [JP] | Japan | 9-136903 |
| Jun. 16, 1997 | [JP] | Japan | 9-158384 |
| Mar. 24, 1998 | [JP] | Japan | 10-075192 |

[51] Int. Cl.[7] ..... G03G 15/08

[52] U.S. Cl. ..... 399/103; 399/105

[58] Field of Search ..... 399/103, 105, 399/264

[56] References Cited

U.S. PATENT DOCUMENTS

| | | | |
|---|---|---|---|
| 5,057,868 | 10/1991 | Sekino et al. | 399/105 |
| 5,073,797 | 12/1991 | Ono et al. | 399/105 |
| 5,202,729 | 4/1993 | Miyamoto et al. | 399/103 |
| 5,212,521 | 5/1993 | Ogawa et al. | 399/264 |
| 5,321,473 | 6/1994 | Azami | 399/103 |
| 5,488,462 | 1/1996 | Ishikawa et al. | 399/103 |
| 5,585,895 | 12/1996 | Yashiro et al. | 399/103 |
| 5,701,558 | 12/1997 | Kojima | 399/103 |

FOREIGN PATENT DOCUMENTS

| | | |
|---|---|---|
| 462391 | 12/1984 | Japan . |
| 2287471 | 11/1990 | Japan . |
| 3109587 | 5/1991 | Japan . |
| 4115271 | 4/1992 | Japan . |
| 4249273A | 9/1992 | Japan . |

OTHER PUBLICATIONS

Patent Abstracts of Japan, Publication No. 05002322 (Aug. 1, 1993).

*Primary Examiner*—Arthur T. Grimley
*Assistant Examiner*—William A. Noe
*Attorney, Agent, or Firm*—Birch, Stewart, Kolasch & Birch, LLP

[57] ABSTRACT

An electrophotography developing apparatus has been developed which can protect a developer holder and a layer thickness control member from damage. The device also prevents internal scattering of the developer while preventing a surplus supply of the developer to both ends on the peripheral surface of the developer holder. The unique advantages of the invention are derived through the utilization of sealing members having different elastic properties, which assume both bulk removal of excess developer while providing the needed uniform developer thickness. Another embodiment of the invention has the width of the layer thickness control member in a longitudinal direction set wider than the width of the developer holder in a longitudinal direction, and both side edges of the layer thickness control member are positioned outside both side edges of the developer holder. Proper sealing is assured by having the inner side edges of the sealing member positioned inside the side edges of the developer holder and outside the side edges of the image area of the image holder.

25 Claims, 14 Drawing Sheets

DEVELOPING APPARATUS

FIELD OF THE INVENTION

The present invention relates to an electrophotographic developing apparatus using a single component developer.

BACKGROUND OF THE INVENTION

Description of the Related Art

Well known technology for developing electrostatic latent images formed on an image holder in a developing apparatus, such as an electrophotographic copying machine, is based on the utilization of a non-magnetic or magnetic single component developer (toner). The ability to control the layer thickness of the developer during the development process is crucial to this technology.

An example of developer thickness control technology is where a layer thickness control member contacts a rotating developer holder in the developing apparatus, so that the developer on the developer holder forms a uniform charged thin film necessary for the developing process. The electric charge is provided by frictional electrification. This thin developer layer is then transferred to a developing position where the image holder contacts the developer holder. As a result, the developer is supplied to the electrostatic latent image formed on the image holder, so that the latent image is developed.

One of electrophotography's foremost technical problems arises from the accumulation of excess developer around both ends of the developer holder, which faces the non-image areas of the image holder. The accumulation of excess developer is due to scattering caused by the rotation of the developer holder, so that the developer migrates to both ends of the developer holder virtually parallel to the longitudinal direction of the developer holder. The result is a surplus supply of the developer, causing the developer to scatter in the apparatus. This scattering of developer then causes contamination problems in the copying machine and results in unnecessary excess consumption of the developer.

A technology for preventing developer wastage and for protecting the developing apparatus from contamination is disclosed in the official report of Unexamined Published Japanese Patent Application No. 4-62391. The developing apparatus disclosed in the official report, shown in FIG. 26 and 27, is provided with an elastic plate-like layer thickness control member 101, a cylindrical developer holder 103, and elastic sealing members 102 covering both side edges 101*a* of the layer thickness control member 101 from the back side of the leading edge 101*b*. The elastic sealing members 102 cover portions on the face of the developer holder 103, which are close to both side edges 101*a* of the layer thickness control member 101. Consequently, the movement of the developer to both ends of the developer holder 103 in an axial direction parallel to a rotary shaft line of the developer holder 103 is restricted.

When the elastic sealing members 102 cover both side edges 101*a* of the layer thickness control member 101 and the face of the developer holder 103 around those side edges 101*a* as described above, to restrict the movement of the developer in the axial line direction, both side edges 101*a* of the layer thickness control member 101 are pressed directly against the face of the developer holder 101. If the developing apparatus is consistently used in this configuration, local damage occurs at a contact portion between the developer holder 103 and both side edges 101*a* of the layer thickness control member 101. This damage generates a gap between the developer holder i03 and the side edges 101*a*, resulting in degradation of the performance of the elastic sealing members 102.

Consequently, the movement of developer to both side edges of the developer holder 103 cannot be completely restricted, causing a surplus supply and scattering of the developer to both edges 101*a* and resulting in problems such as contamination in the developing apparatus and unnecessary consumption of the developer. This effect is exacerbated when the layer thickness control member 101 and the developer holder 103 are composed of different materials, each of which has mechanical characteristics significantly different from each other. For example, when the layer thickness control member 101 is composed of a plate-like metallic material and the developer holder 103 is composed of a roller-like rubber material, such the symptoms appear more markedly.

An additional prior art example is shown in FIG. 27. The edges 101*c* at both sides 101*a* of the layer thickness control member 101 contact the elastic sealing members 102 in the axial line direction. A problem arises from this contact as follows: each of the elastic sealing members 102 is stepped and the toner leaks from the gap S generated from this stepped portion and migrates to both ends of the developer holder 103.

Japanese Unexamined Patent Publication JP-A 4-249273 (1992) discloses a technology for eliminating such a stepped portion. FIG. 28 shows a layer thickness control member 111 held in place by dividing each sealing member 112 into a sealing member 112*a* used for the developer holder 113 and a sealing member 112*b* used for the layer thickness control member 111.

When the sealing members 112*a* and 112*b* are composed of different materials, the structure of sealing member 112 is complicated. In addition, since the sealing members 112*a* and 112*b* are bonded unitarily, problems will arise when the developer leaks from the bonded section, which results if the sealing property of the bonded section is low. Furthermore, two types of sealing members are needed for proper sealing. Therefore, another problem, an increase of the manufacturing cost, arises.

Referring to FIG. 26, both side edges 101*a* of the layer thickness control member 101 are restricted by the elastic sealing members 102 in the developing apparatus disclosed in Japanese Unexamined Patent Publication JP-A 4-62391 (1992). As a result, the pressure applied to both side edges 101*a* of the layer thickness control member 101 differs from the pressure applied to other portions. Consequently, a layer of developer is not uniformly formed on the developer holder 103, so the copying machine forms images having an uneven density of developer.

Furthermore, Japanese Unexamined Patent Publications JP-A 3-109587 (1991) and 2-287471 (1990) disclose technologies for restricting the movement of the developer in every direction other than in the one expected for feeding the developer in the developing apparatus having the configuration described above. The developing apparatus disclosed in JP-A 3-109587 forms sealing members for restricting the movement of the developer to the one expected for feeding the developer by using bristle set sealing members, each of which is composed of many types of materials. The developing apparatus disclosed in JP-A 2 -287471(1990) is provided with a sheet for preventing developer leakage from a developing tank, which sheet is in contact with the outer peripheral surface of the developer holder in the developing tank, and the pressure with which the sheet is in contact with the outer peripheral surface is higher at the end portions of the sheet than in the center portion.

Japanese Unexamined Patent Publication JP-A 4-115271 (1992) discloses prior art for preventing the developer holder or the layer thickness control member from damage in the developing apparatus described above. In the case of the layer thickness control member, the width of the layer thickness control member in the direction parallel to the rotary shaft of the developer holder is wider than the width of the developer holder.

When any of the developing apparatuses and the developing units in the three official reports described above are used, it is difficult to prevent the developer holder and the layer thickness control member from becoming damaged. As a result, the prior art is unable to restrict the movement of the developer to the one desired for feeding the developer.

SUMMARY OF THE INVENTION

The present invention provides an electrophotography developing apparatus capable of forming images of uniform density by forming a uniform layer of developer without damaging the developer holder or the layer thickness control member.

The invention also provides a developing apparatus capable of preventing problems such as contamination by scattering of the developer in the apparatus and the unnecessary consumption of developer. The invention also eliminates contact between the developer holder and the layer thickness control member to protect them from damages and prevent a surplus supply of the developer from accumulating at the ends of the developer holder.

The invention also provides a developing apparatus capable of solving problems such as contamination arising from scattering of the developer in the apparatus and unnecessary consumption of developer while eliminating a gap between both ends of the layer thickness control member in a longitudinal direction, thereby preventing developer leakage and an excess supply of developer to both ends of the developer holder.

DETAILED DESCRIPTION OF THE PREFERRED EMBODIMENTS

Figure 1:
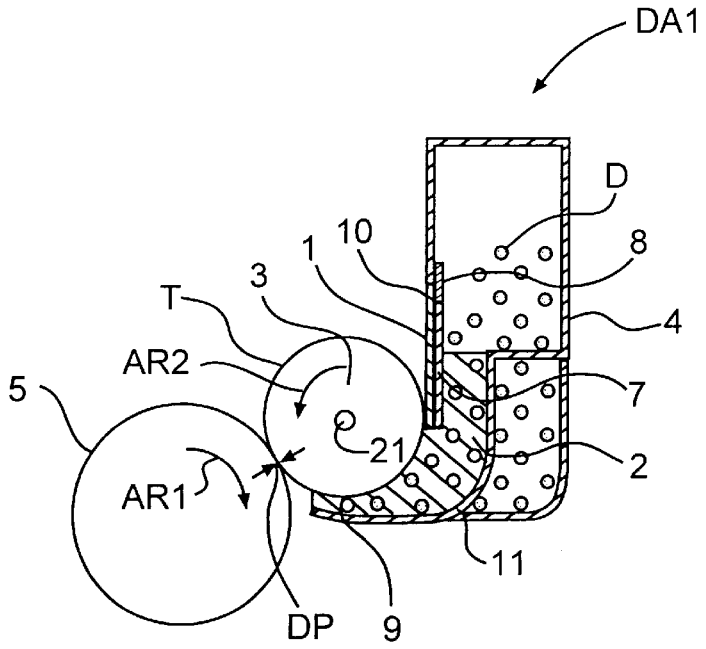
FIG. 1 is a schematic vertical cross sectional view of a developing apparatus DA1 in a first embodiment of the present invention.
Figure 2:
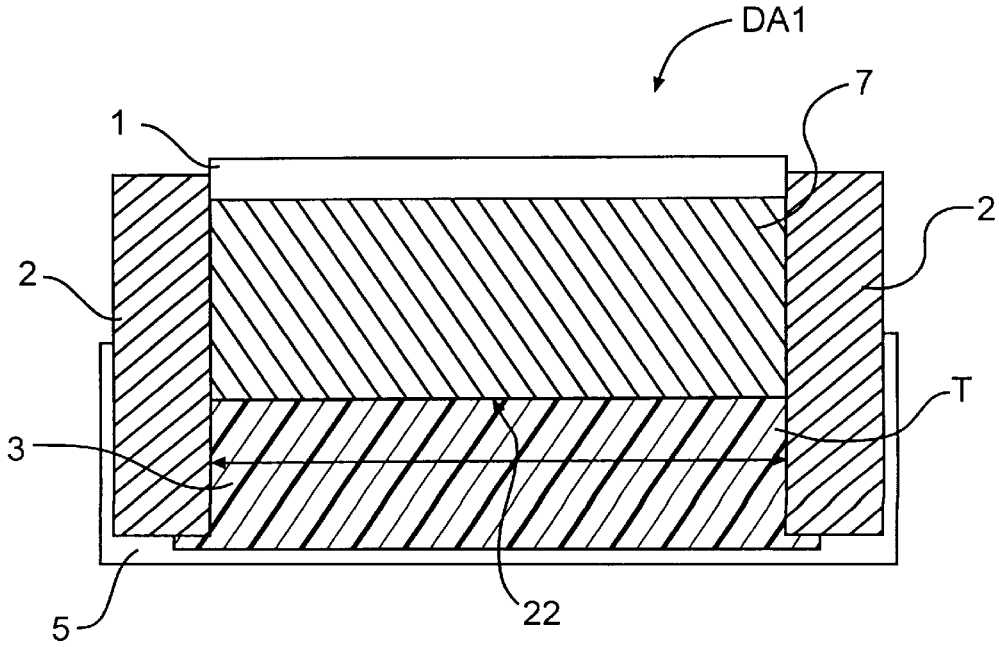
FIG. 2 is a side view of the major portion of the developing apparatus DA1 in the first embodiment.
Figure 3:
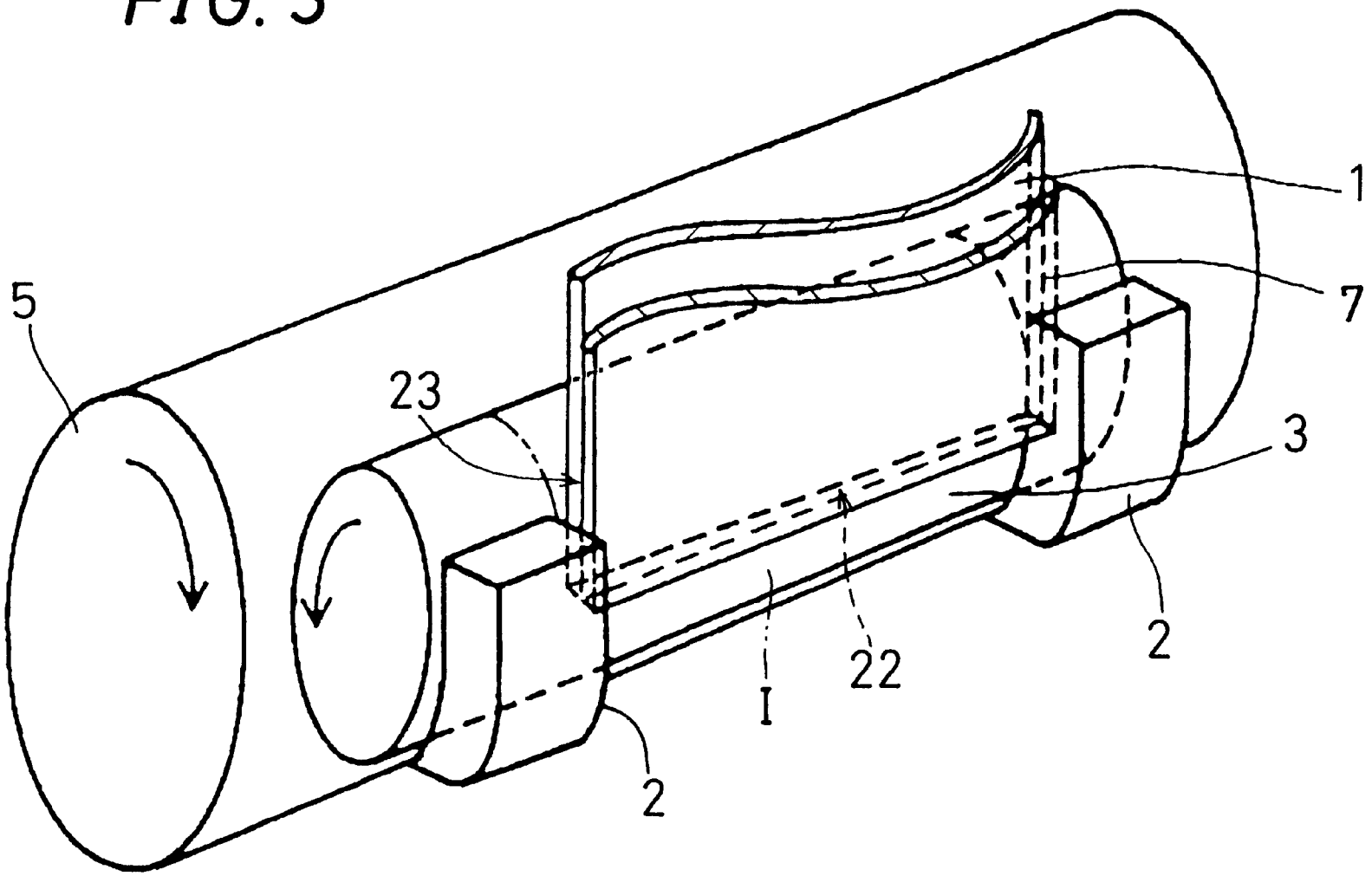
FIG. 3 is a perspective view of the major portion of the developing apparatus DA1 in the first embodiment.

FIG. 1 is a schematic vertical cross sectional view of a structure of a developing apparatus DA1 in a first embodiment of the present invention. FIGS. 2 and 3 are a side view and a perspective view of the major portion of the developing apparatus DA1. The schematic configuration of the developing apparatus DA1 will be described with reference to FIGS. 1 to 3. The developing apparatus DA1 is applicable, for example, an electrophotographic laser printer. The developing apparatus DA1 comprises a layer thickness control member 1, a pair of both-end elastic sealing members 2, a developer holder 3, a developer case 4, a back side elastic sealing member 7, an upper sealing member 8, and a lower sealing member 9. The developer case 4 stores developer D. The developer case 4 has an opening 10. In FIGS. 2 and 3, the developer case 4, the upper and lower sealing members 8 and 9 are omitted.

The cylindrical developer holder 3 is disposed at the opening of the developer case 4 so that the holder 3 is gradually supplied with developer 4 on the surface of the holder 3. The developer holder 3 is formed from, for example, a conductive rubber material. The developer D is, for example, high resistant toner whose average particle size is about 15 $\mu$m.

The developer holder 3 is disposed so that its face faces the side face of the image holder 5 provided in the laser printer and part of its surface contacts or nearly contacts the image holder 5. A position where the developer holder 3 contacts or nearly contacts the image holder 5 is referred to as a developing position DP. The image holder 5 is composed of, for example, a photosensitive drum or a photosensitive belt and rotated in a direction of the arrow AR1. At a position that faces both ends of the developer holder 3 in a longitudinal direction on the peripheral surface, and also are in the vicinity of an opening 10 in the developer case 4, are disposed both-end elastic sealing members 2 used to prevent an excess of developer D from forming at both ends of the developer holder 3. The longitudinal direction is in parallel to the rotary shaft of the developer holder 3 and crosses the direction in which the developer holder 3 feeds the developer D at a right angle.

The developer holder 3 is rotatably supported via, for example, a shaft 21 at both ends of itself and rotated at a specified speed in a direction of the arrow AR2 so as to hold the developer D supplied from the developer case 4 on its surface and feeds the developer D up to the developing position DP. Thus, an electrostatic latent image is formed on the surface of the image holder 5. The developing apparatus DA1 visualizes the electrostatic latent image using the developer D fed to the developing position DP by the developer holder 3 to form a developed image.

At the upstream side of the developing position DP in the rotating direction AR2 of the developer holder 3 of the developer case 4, the layer thickness control member 1 is disposed. As shown in FIGS. 2 and 3, a leading edge 22 on the face of the layer thickness control member 1 or a portion around the leading edge 22 is disposed so as not to touch the both-end elastic sealing members 2 provided at both ends of the developer holder 3.

At the back side of the layer thickness control member 1 is disposed a back side elastic sealing member 7 so that the side end faces of the back side sealing member 7 slidably contact the side end faces of the both-end elastic sealing members 2 of the developer holder 3. The back side elastic sealing member 7 and the both-end elastic sealing members 2 are used together to seal the developer D.

The location of elastic sealing members 2 and 7 are disposed in such a way that both ends 23 of the layer thickness control member 1 are not pressed directly from the back side by the both-end elastic sealing members 2 of the developer holder 3. Consequently, the developer holder 3 is protected from local damage, and accordingly, the developer is not excessively fed. As a result, the developing apparatus is prevented from contamination caused by internal scattering of the developer, as well as other problems such as unnecessary consumption of the developer, etc.

The layer thickness control member 1 restricts the amount of developer D supplied from the developer case 4 onto the surface of the developer holder 3 so as to form a thin developer layer T on the surface of the developer holder 3.

The upper sealing member 8 seals between the developer case 4 and the upper portion of the layer thickness control member 1. The lower sealing member 9 seals between the developer case 4 and the lower portion of the developer holder 3.

In the first embodiment, the configuration of the developing apparatus DA1 is as follows. The layer thickness control member 1 is composed of a stainless steel plate of 0.1 mm in thickness. The layer thickness control member 1 is fixed to the developer case 4 so that the leading edge 22 or a portion around the leading edge 22 of the layer thickness control member 1 is pressed against the developer holder 3 due to its own elastic force. The distance between the portion of the layer thickness control member 1 fixed on the developer case 4 and the portion of the layer thickness control member 1 in contact with the developer holder 3 is 10 mm and the deflection is 1 mm. Since the layer thickness control member 1 is pressed against the developer holder 3 with a uniform force, the thickness of the thin developer layer T and the charge of the developer can be kept stable.

Around at both ends of the developer holder 3 are disposed a pair of both-end elastic sealing members 2, as are described above, to prevent a surplus supply of the developer D from migrating to both ends of the peripheral surface of the developer holder 3. Each inner side edge of the both-end elastic sealing members 2 is positioned (when viewed from one side of the developing apparatus DA1) between an outside edge of the developer holder 3 and an outside edge of an image area on the image holder where electrostatic latent images are formed, so that the sealing members 2 are in contact with the face of the developer holder 3 and the back of the layer thickness control member 1.

On the back side of the layer thickness control member 1 is stuck the back side elastic sealing member 7. Both ends of the back side elastic sealing member 7 are in contact with the side ends of the both-end elastic sealing members 2 due to a certain pressure. More concretely, the back side elastic sealing member 7 is composed of flexible urethane sponge and is stuck on the back side of the layer thickness control member 1 with a double-sided adhesive tape. On the other hand, the both-end elastic sealing members 2 are composed of moquette having a certain elastic force. The both-end elastic sealing members 2 are held at its back side by projections 11 in the developer case 4.

The thin developer layer T formed on the developer holder 3 is used for developing the electrostatic latent images on the image holder 5 after it is fed to a position at or around the position where the image holder 5 contacts the developer holder 3 at the developing position DP. In the first embodiment, the same polarity voltage as that of the charge voltage of the thin developer layer T is applied to the developer holder 3, and a potential difference from the potential of the electrostatic latent image formed on the image holder 5 is used to develop the image. This completes the explanation for the configuration of the developing apparatus DA1.

Figure 4:
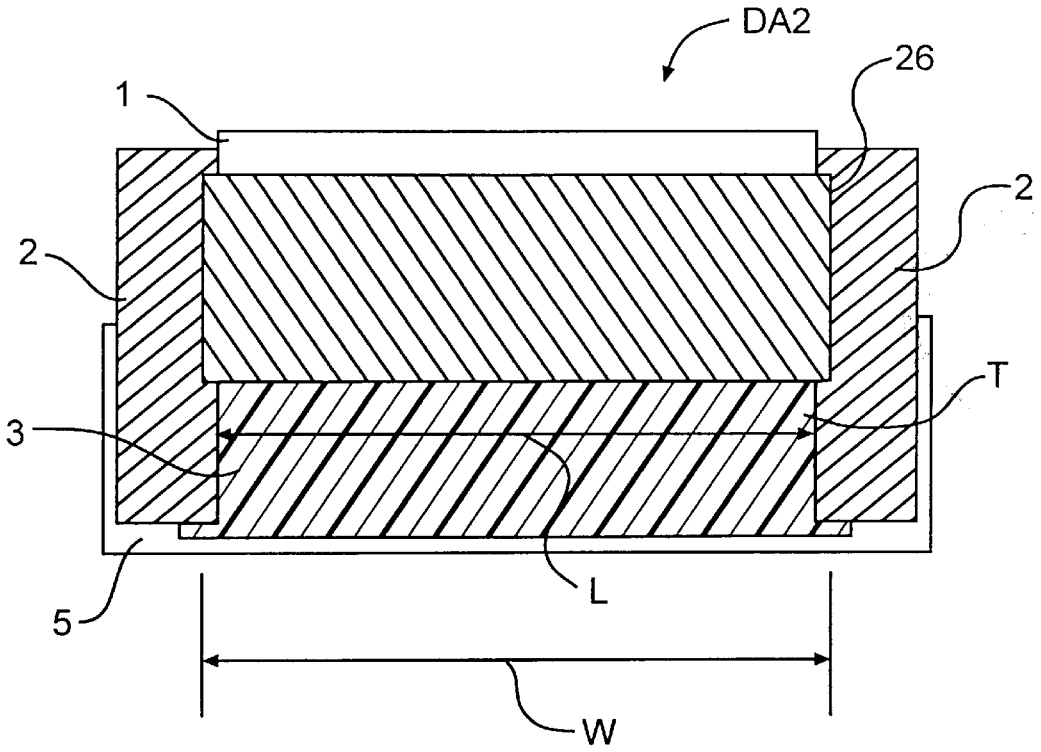
FIG. 4 is a side view of the major portion of a developing apparatus DA2 in a second embodiment of the present invention.
Figure 5:
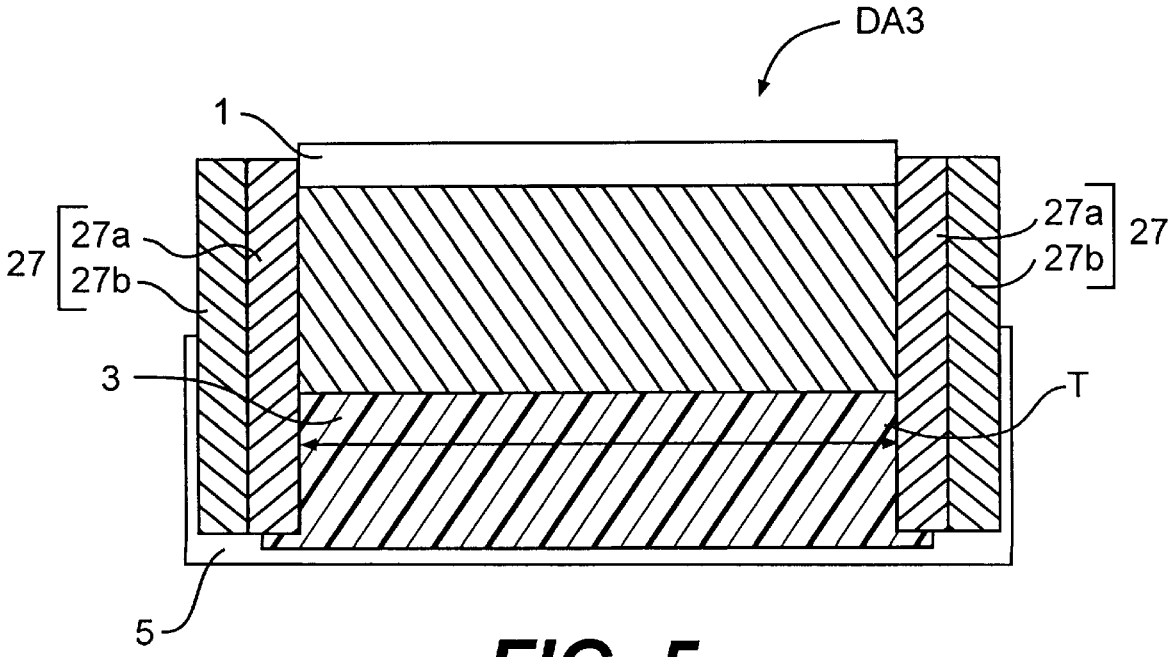
FIG. 5 is a side view of the major portion of a developing apparatus DA3 in a third embodiment of the present invention.

Hereafter, the developing apparatuses DA2 to DA5 in the second to fifth embodiments will be described with reference to FIGS. 4 to 7. Each of the developing apparatuses DA2 to DA5 in the second to fifth embodiments includes parts having the same structures and the same functions as those of the developing apparatus DA1 in the first embodiment. Those parts are all positioned and disposed in the second to fifth embodiments just like in the first embodiments. In the following explanation, parts which are the same as those in the developing apparatus DA1 of the first embodiment, of parts which compose each of the developing apparatuses DA2 to DA5 will be denoted by the same reference numerals, and the same reference numerals will be given to those parts and the explanation for them will be omitted, avoiding redundant explanation. In FIGS. 4 and 5, the developer case 4 and the upper and lower sealing members 8 and 9 are omitted.

The developing apparatus DA2 of the second embodiment will be described with reference to FIG. 4 (a side view). The developing apparatus DA2, when compared with the developing apparatus DA1 in the first embodiment, is different in that the back side elastic sealing member 7 in the DA1 is replaced with a back side elastic sealing member 26. Other items are the same in both embodiments.

The back side elastic sealing member 26 disposed on the back side of the layer thickness control member 1 is formed so that its length W in a width direction is a little wider than the width L of the image area. Thus, the contact pressure between both ends of the developer holder 3 and the both-end elastic sealing members 2 is effectively improved. Since the back side elastic sealing member 26 is disposed this way, the developer is sealed more effectively.

The developing apparatus DA3 in the third embodiment will be described with reference to FIG. 5 (a side view). The developing apparatus DA3, when compared with the developing apparatus DA1 in the first embodiment, is different in that a pair of both-end elastic sealing members 2 in the DA1 is replaced with a pair of both-end elastic sealing members 27, which have the following structure, respectively. Other items are the same in both embodiments.

Each of the pair of both-end elastic sealing members 27 is composed of two types of sealing members 27*a* and 27*b* disposed along the width direction of the developer holder 3 and given a different elasticity from the other. Although both sealing members 27*a* and 27*b* are elastic to both ends of the developer holder 3, the elasticity of the sealing member 27*a* is set higher than the sealing member 27*b*.

In the third embodiment, specifically, the inner sealing member 27*a* is composed of solid-like rubber of 40° in hardness, and the outer sealing member 27*b* is composed of urethane sponge of 10° in hardness, and they are positioned toward both ends of the developer holder 3 so that a difference is generated in elasticity between the sealing members 27*a* and 27*b*.

Consequently, the developer D moving toward both ends of the developer holder 3 is initially restricted once by the sealing member 27*a* having a large elasticity. Then, the developer D that cannot be restricted by the sealing member 27*a* is wiped off by the sealing member 27*b* having a small elasticity. As a result, the developer D is restricted so as not to be excessively supplied to both ends of the developer holder 3.

Since the developing apparatus DA3 has such a configuration, the developer holder 3 is protected from an excessive supply of the developer more effectively and accordingly, the developing apparatus DA3 is prevented from internal contamination by scattering of the developer, as well as suppressing unnecessary consumption of the developer.

When the less elastic sealing member 27*b* is composed of a fiber sealing member, the developer can be wiped more effectively, preventing the developing apparatus from contamination by internal scattering of the developer and from suppressing unnecessary surplus consumption of the developer.

Figure 6:
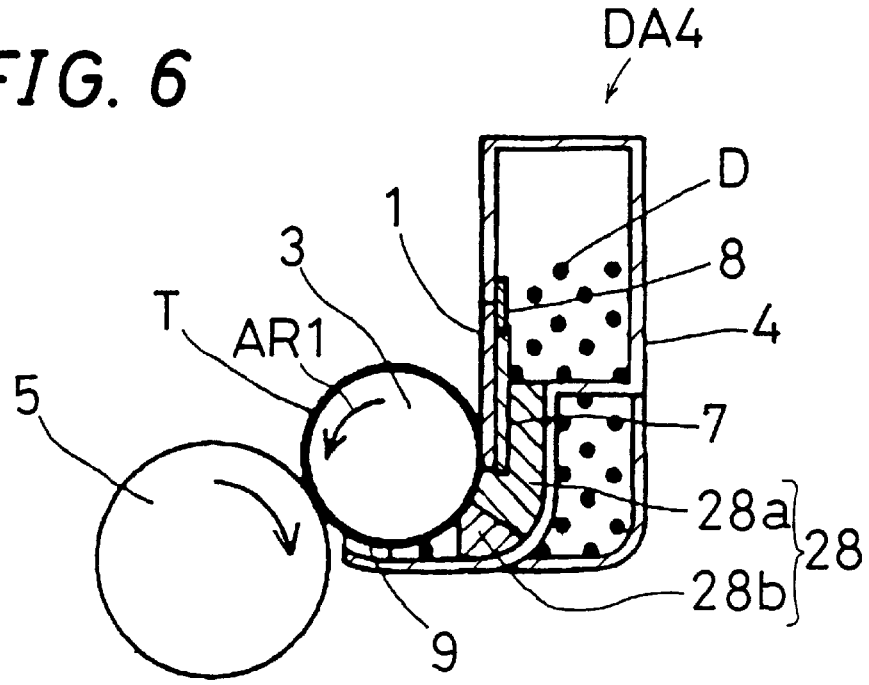
FIG. 6 is a schematic vertical cross sectional view of a developing apparatus DA4 in a fourth embodiment of the present invention.

The developing apparatus DA4 in the fourth embodiment will be described with reference to FIG. 6 (a vertical cross sectional view). The developing apparatus DA4, when compared with the developing apparatus DA1 in the first embodiment, has a difference that a pair of both-end elastic sealing members 2 in the DA1 is replaced with a pair of both-end elastic sealing members 28, which have the following structure, respectively. Other items are the same in both embodiments.

Each of the pair of both-end elastic sealing members 28 is composed of two types of sealing members 28*a* and 28*b* disposed along the peripheral surface of the developer holder 3 and given a different elasticity from the other. Each of the sealing members 28*a* and 28*b* is disposed so as to contact the peripheral surface of the developer holder 1. Each of the elasticities of the sealing members 28*a* and 28*b* is set so that the elasticity of the sealing member 28*a* provided at the upstream side in the rotating direction of the developer holder 3 is stronger than the other sealing member 28*b* provided at the downstream side.

In the fourth embodiment, specifically, the sealing member 28*a* provided at the upstream side in the rotation direction of the developer holder 3 is composed of solid-like rubber of 40° in hardness and the sealing member 28*b* at the downstream side is composed of urethane sponge of 10° in hardness so that a difference is generated in elasticity between the sealing members 28*a* and 28*b*. The elasticity of sealing member 28*a* is greater than that of sealing member 28*b*.

Consequently, the developer D moving toward both ends of the developer holder 3 is restricted initially by the sealing member 28*a* having a large elasticity. Then, the developer D that cannot be restricted by the sealing member 28*a* is wiped off by the sealing member 28*b* having a small elasticity. As a result, the developer D is restricted so as not to be excessively supplied to both ends of the developer holder 3.

Since the developing apparatus DA3 has such a configuration, the developer holder 3 is prevented from supply excess of the developer more effectively, and accordingly, the developing apparatus DA3 is prevented from contamination by scattering of the developer in the apparatus, as well as suppressing unnecessary consumption of the developer.

When the less elastic sealing member 28*b* is composed of a fiber sealing member, the developer can be wiped more effectively, thus preventing the developing apparatus from contamination by internal scattering of the developer in the apparatus and suppressing unnecessary consumption of the developer more effectively.

Figure 7:
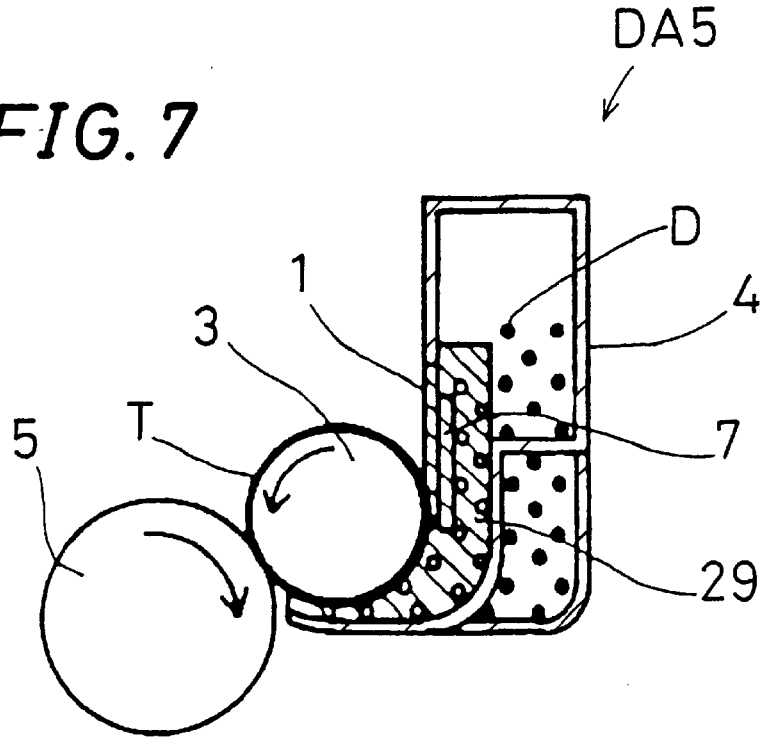
FIG. 7 is a schematic vertical cross sectional view of a developing apparatus DA5 in a fifth embodiment of the present invention.

The developing apparatus DA5 in the fifth embodiment will be described with reference to FIG. 7 (a vertical cross sectional view). The developing apparatus DAS in the fifth embodiment, when compared with the developing apparatus DA1 in the first embodiment, has a difference in that the three sealing members 2, 8, and 9 in the DA1 are replaced with a sealing member 29, which has the following structure. Other items are the same in both embodiments.

The sealing member 29 is formed by uniting into one the both-end elastic sealing members 28 provided at both ends of the developer holder 3, the upper sealing member 8 sealing the upper portion between the layer thickness control member 1 and the developer case 4, and the lower sealing member 9 sealing the lower portion between the layer thickness control member 1 and the developer case 4. Since such an all-in-one sealing member 29 is used, the joint lines formed at the seams between sealing portions 2, 8, and 9 are eliminated with a simple unified structure. Leaks of the developer D from the developer case 4 through seams in the sealing portions caused by vibrations, impacts, etc. can thus be prevented.

Figure 8:
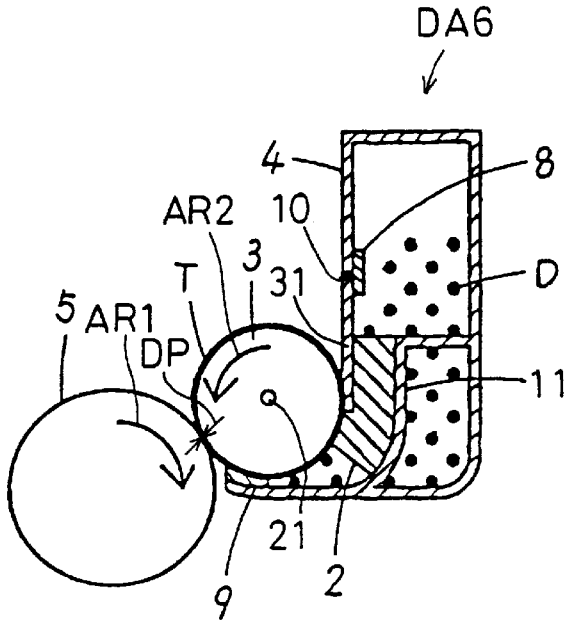
FIG. 8 is a schematic vertical cross sectional view of a developing apparatus DA6 in a sixth embodiment of the present invention.
Figure 9:
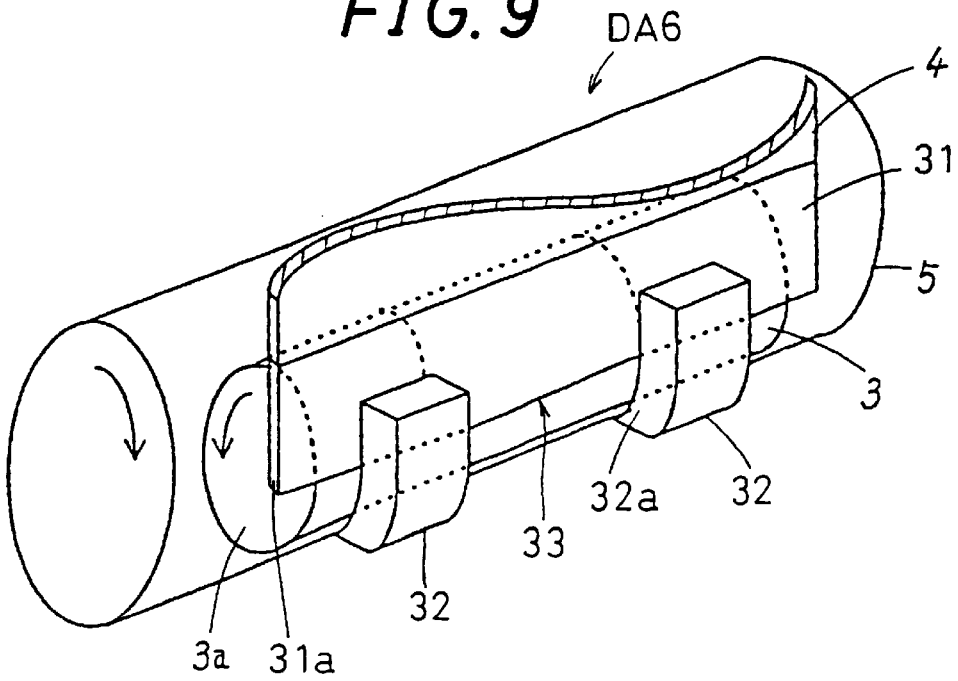
FIG. 9 is a perspective view of the major portion of the developing apparatus DA6 in the sixth embodiment of the present invention.
Figure 10:
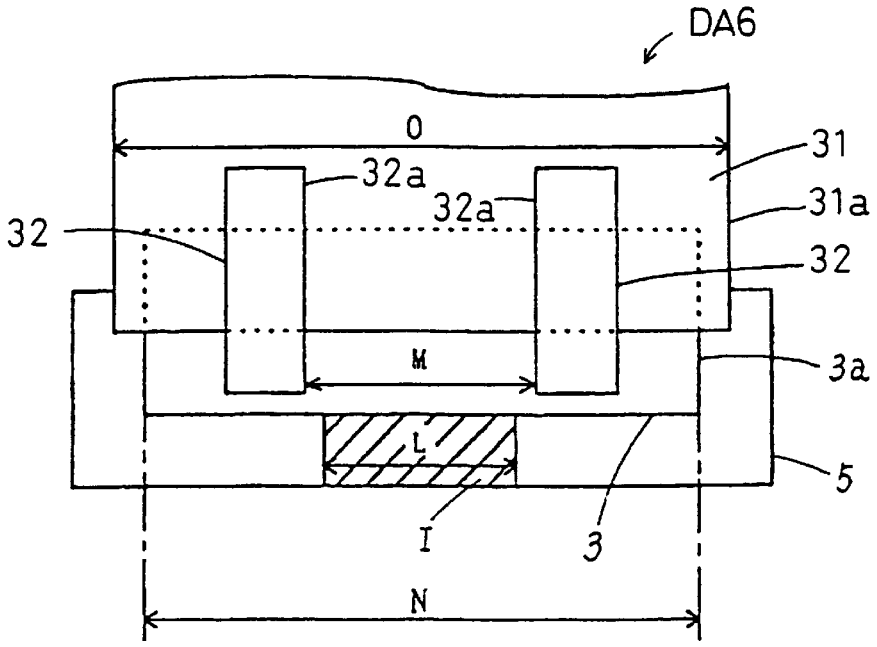
FIG. 10 is a side view of the major portion of the developing apparatus DA6 in the sixth embodiment of the present invention.
Figure 11:
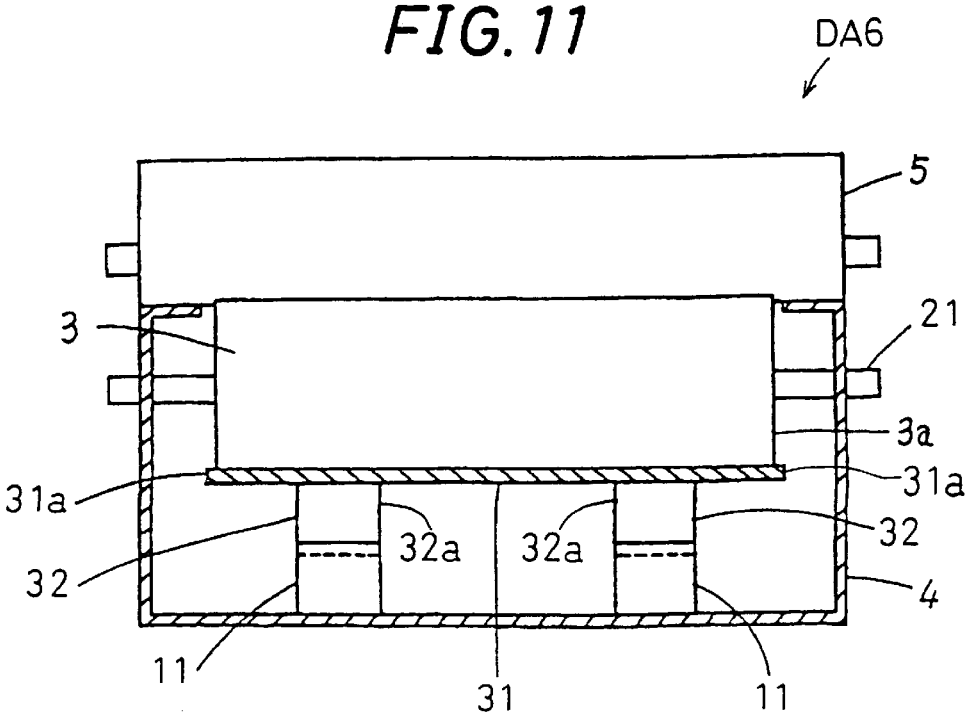
FIG. 11 is a horizontal cross sectional view of the major portion of the developing apparatus DA6 in the sixth embodiment of the present invention.

FIG. 8 is a schematic vertical cross sectional view of a structure of the developing apparatus DA6 in a sixth embodiment of the present invention. FIGS. 9 to 11 are perspective, side, and horizontal cross sectional views of the major portion of the developing apparatus DA6. Hereafter, a schematic configuration of the developing apparatus DA6 will be described with reference to FIGS. 8 to 11. The developing apparatus DA6 in the sixth embodiment includes parts having the same structures and the same functions as those of the developing apparatus DA1 in the first embodiment. Thus, the same reference numerals will be given to those parts.

The developing apparatus DA6 includes a layer thickness control member 31, a pair of seals 32, a developer holder 3, a developer case 4, an upper sealing member 8, and a lower sealing member 9. The developer D is stored in the developer case 4. The developer case 4 is provided with an opening 10, as well as a stirring member, a feeding member, etc.

The developing apparatus DA6 in the sixth embodiment is applicable for an electrophotographic laser printer. The cylindrical developer holder 3 is disposed in the developer case 4 that gradually feeds the developer D, composed of a non-magnetic single component, onto the peripheral surface of the developer holder 3. The developer D is composed of, for example, a high resistant toner whose average particle size is 10 $\mu$m. The developer holder 3 is composed of a conductive rubber roller. Both ends of the developer holder 3 are rotatably supported at the developer case 4 via a shaft 21. The developer holder 3 is rotated at a specified speed. The developer holder 3 is disposed so as to contact or nearly contact the image holder 5, which is composed of a rotatable photosensitive drum or a photosensitive belt, and holds the developer D supplied from the developer case 4 on its surface and feeds the developer D up to a developing position DP facing the image holder 5.

The developer holder 4 is provided with a layer thickness control member 31 that forms a thin layer T of the developer D on the surface of the developer holder 3 by restricting the layer thickness of the developer D fed from the developer case 4. The layer thickness control member 31 is composed of a stainless steel plate of, for example, 0.1 mm in thickness. The layer thickness control member 31 is fixed to the developer case 4 at its one end at the developer case side. The layer thickness control member 31 is disposed at the upstream side of the developing position DP in the feeding direction AR2 of the developer by the developer holder 3. The leading edge portion 33 or a portion around the leading edge 33 of the layer thickness control member 31 on its surface contacts the developer holder 3 all along the longitudinal direction. The distance between the portion to contact the developer case 4 in the layer thickness control member 31 and the portion to contact the developer holder 3 is 10 mm and the deflection is 1 mm. The layer thickness control member 31 is pressed against the developer holder 3 due to its own elasticity. Since the layer thickness control member 31 is pressed against the developer holder 3 in uniform due to its own elasticity, the developer layer can be kept at a specified thickness T, and the developer D can acquire the necessary charge by frictional electrification.

The width 0 of the layer thickness control member 31 in the longitudinal direction is set wider than the width N of the developer holder 3 in the longitudinal direction (O>N) so that the layer thickness control member 31 contacts the developer holder 3 all along the longitudinal direction. Both side edges 31*a* of the layer thickness control member 31 are positioned outside both side edges 3*a* of the developer holder 3 and do not contact the surface of the developer holder 3. The width O of the layer thickness control member 31 in the longitudinal direction may be equal to the width N of the developer holder 3 in the longitudinal direction.

In order to prevent excessive supply of the developer D to both ends of the developer holder 3, a pair of elastic seals 32 are provided in the developer case 4. Each of the seals 32 is composed of flexible urethane sponge or an elastomer such as synthetic rubber, etc. The seals 32 are disposed around both ends of the developer holder 3. The seals 32 are held at its back side by projections 11 in the developer case 4 and pressed against the developer holder 3 and the layer thickness control member 31 so as to contact both the face of the developer holder 3 and a back side of the layer thickness control member 31. Since the seals 32 are elastic, they can follow up the developer holder 3 and the layer thickness control member 31 regardless of the difference in level between the layer thickness control member 31 and the developer holder 3 so that the member 32 can closely contact the holder 3 and the layer thickness control member 31. In addition, no action is restricted around the leading edge of the layer thickness control member 31.

When seen from the side of the developing apparatus DA6 (reference to FIG. 10), the seals 32 are separated from each other so that inner edges 32*a* of the seals 32 are positioned between the side edges 3*a* of the developer holder 3 and the extended lines of the side edges of the image area I on the image holder 5 respectively. In other words, the width M between the inner edges 32*a* of the seals 32 is set wider than the width L of the image area I (M>L). The upper sealing member 8 seals between the developer case 4 and the layer thickness control member 31. The lower sealing member 9 seals between the developer case 4 and the developer holder 3.

Hereunder, explanation will be made for the procedure for developing an electrostatic latent image on the image holder 5 using the developing apparatus DA6 composed as described above.

The developer D is gradually supplied from the developer case 4 onto the surface of the developer holder 3 rotating in the direction of the arrow AR2. At this time, the developer D in the developer case 4 is moved by a stirring member, a feeding member, etc. to the developer holder 3, but the seals 32 restrict the movement of the developer D to both ends of the developer holder 3. Excessive supply of the developer D to these areas is thus prevented.

The developer D fed to a portion between both seals 32 on the peripheral surface of the developer holder 3 is restricted by the layer thickness control member 31 so that the developer layer T on the developer holder 3 is kept properly thin. At this time, the developer D is charged by frictional electrification to a level of charge necessary for developing the developer. This thin developer layer T is fed to the developing position DP where the image holder 5 is in contact or almost in contact with the developer holder 3 according to the rotation of the developer holder 3. The developer holder 3 is receiving the same polarity voltage as that of the thin developer layer T of the developer charged by frictional electrification at this time. Thus, the developer is supplied to the electrostatic latent image on the image holder 5 by using the potential difference from that of the latent image formed on the image holder 5, so that the image is developed.

Since the developer D is not fed excessively to both ends of the developer holder 3, which are non-image areas, the developer D that is not used for development is never scattered. In addition, since both side edges 31*a* of the layer thickness control member 31 are prevented from directly touching the surface of the developer holder 3, no local damage is caused by the contact of the developer holder 3 with both side edges 31*a* of the layer thickness control member 31. Consequently, excessive supply of the developer D to both ends of the developer holder 3, caused by such a local damage, is prevented. Accordingly, contamination by scattering of the developer D inside the developing apparatus is also prevented. In addition, other problems such as unnecessary consumption of the developer D can be prevented.

Figure 12:
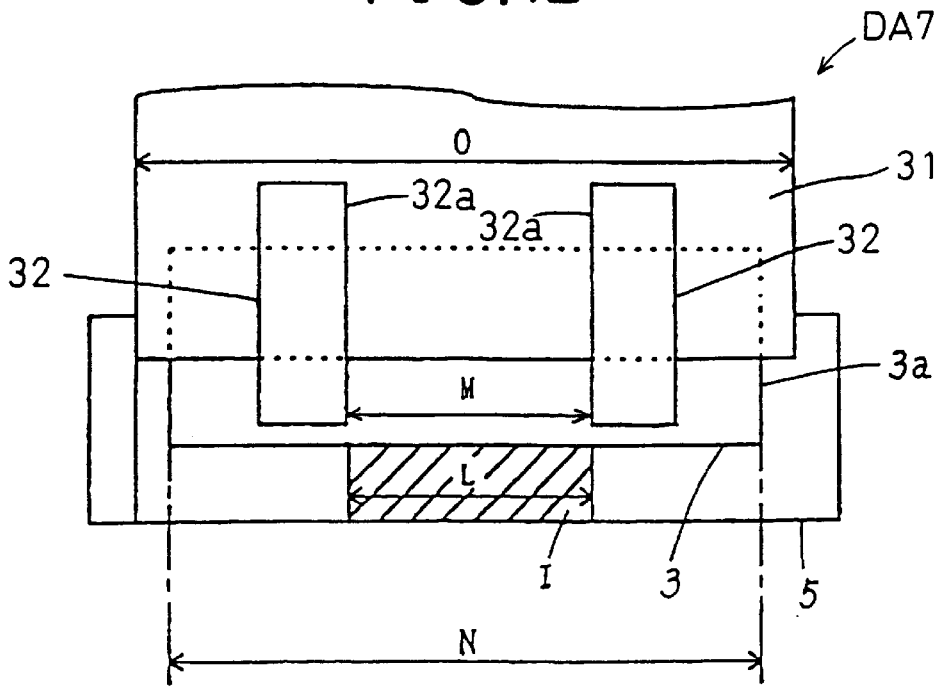
FIG. 12 is a side view of the major portion of a developing apparatus DA7 in a seventh embodiment of the present invention.
Figure 13:
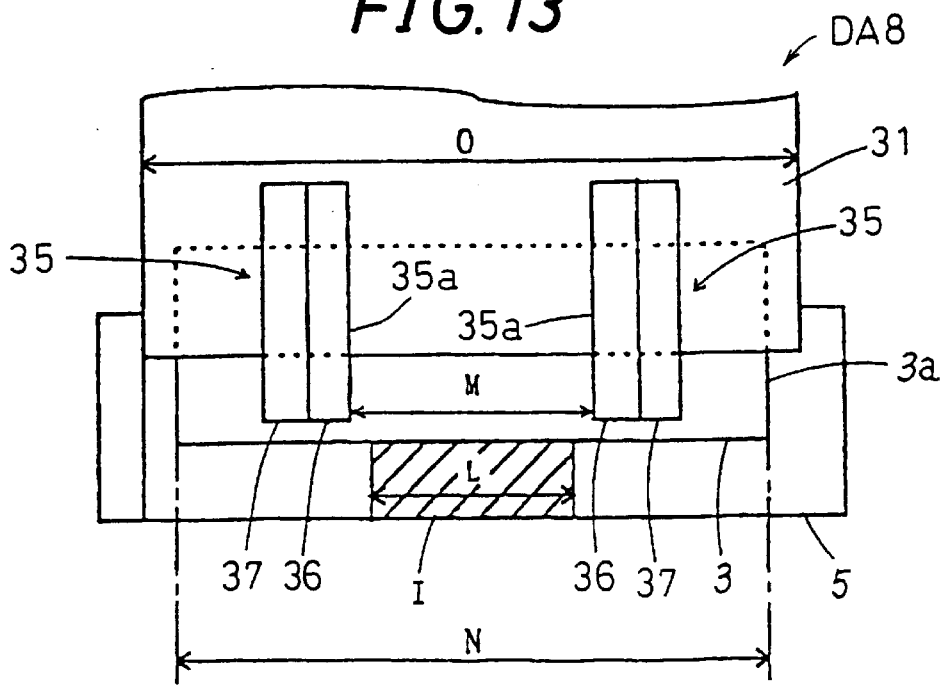
FIG. 13 is a side view of the major portion of a developing apparatus DA8 in an eighth embodiment of the present invention.
Figure 19:
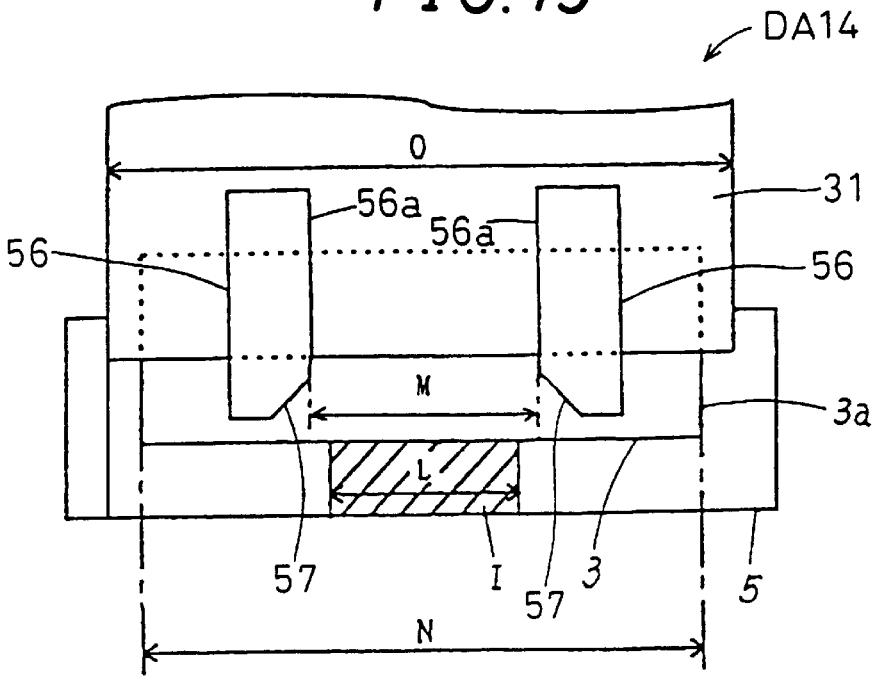
FIG. 19 is a side view of the major portion of a developing apparatus DA14 in a fourteenth embodiment of the present invention.

The developing apparatuses DA7 to DA15 in seventh to fifteenth embodiments will be described with reference to FIGS. 12 to 18. Each of the developing apparatuses DA7 to DA15 in the seventh to fifteenth embodiments include some parts having the same structures and the same functions as those of the developing apparatus DA6 in the sixth embodiment. Those parts are all positioned and disposed in the seventh to fifteenth embodiments just like in the sixth embodiments. Thus, the same reference numerals will be given to those parts and the explanation for them will be omitted, thereby avoiding redundant explanation. In FIGS. 12, 13, and 19 (side views), the developer case 4, the upper and lower sealing members 8 and 9 are omitted.

Hereafter, the developing apparatus DA7 in the seventh embodiment will be described with reference to FIG. 12 (side view). The developing apparatus DA7, when compared with the developing apparatus DA6 in the sixth embodiment, has a difference that a pair of seals 32 in the DA7 is disposed differently from those in the DA6. Other items are the same in both embodiments.

In the developer DA7, the extended lines of the side edges of the image area I on the image holder 5 may be aligned to the inner edges 32*a* of the seals 32 (M=L). In other words, in the developing apparatus DA6 in the sixth embodiment, the distance between the seals 32 may be equal to the width of the image area I so that the inner edges 32*a* of the seals 32 are disposed on the extended lines of the side edges of the image area I. Consequently, a surplus supply of the developer D to both ends of the developer holder 3 can be suppressed more effectively, so that contamination by scattering of the developer D inside the developing apparatus, as well as other problems such as unnecessary consumption of the developer D can be minimized.

FIG. 13 is a side view of the major portion of a developing apparatus DA8 in the eighth embodiment. The developing apparatus DA8, when compared with the developing apparatus DA6 in the sixth embodiment, has a difference that a pair of seals 32 in the DA6 is replaced with a pair of seals 35, which have the following structure respectively. Other items are the same in both embodiments.

Each of the pair of seals 35 has an inner edge 35*a* and is divided into two types of sealing members 36 and 37, each of which has an elasticity different from the other. The elasticity of each of the sealing members 36 and 37 is set so the sealing member 36 positioned inside in the longitudinal direction of the developer holder 3 has stronger elasticity than the sealing member 37 positioned outside. For example, the inner sealing member 36 is composed of solid-like rubber of 40° in hardness and the outer sealing member 37 is composed of urethane sponge of 10° in hardness. Both members 36 and 37 are bonded into one or they are put in the developer case 4 so as to be in contact closely with each other. Other items such as configuration and disposition of the seals 35 are the same as those of the seals 32 in the sixth embodiment.

Consequently, the developer D moving toward both ends of the developer holder 3 is initially restricted by the inner sealing member 36 having a large elasticity. Then, the developer D that cannot be restricted by the inner sealing member 36 is wiped off by the outer sealing member 37 having a small elasticity. As the particles of the developer D become finer to cope with higher resolution of images, the sealing members 35 are more effective than the case in the sixth embodiment where the sealing members 32 are simply pressed against the developer holder 3.

Since seals 35 having different elasticities in the longitudinal direction of the developer holder 3 are used, one part of the seal 35 restricts the developer D with its elastic portion and the other part of the seal wipes off the developer D that cannot be restricted by the former one with its elastic portion. Thus, a surplus supply of the developer D to the developer holder 3 can be suppressed more effectively.

When the less elastic outer sealing member 37 is composed of a fiber sealing member, the developer D can be wiped more effectively, preventing the developing apparatus from contamination by scattering of the developer D inside itself and suppressing unnecessary consumption of the developer D more effectively.

Figure 14:
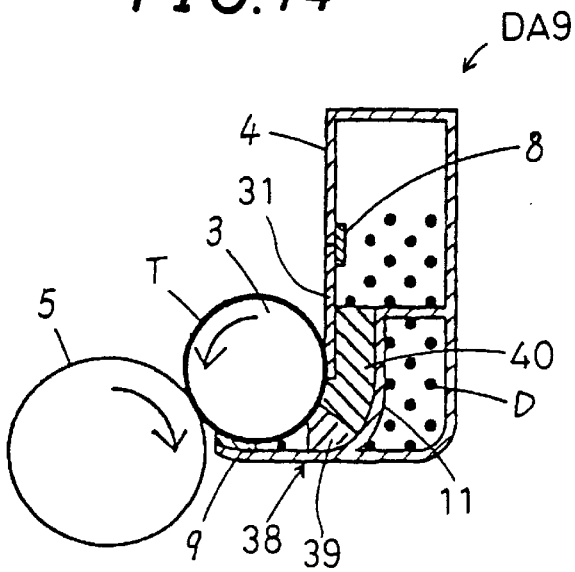
FIG. 14 is a schematic vertical cross sectional view of a developing apparatus DA9 in a ninth embodiment of the present invention.

FIG. 14 is a vertical cross sectional view of the developing apparatus DA9 of the ninth embodiment. The developing apparatus DA9, when compared with the developing apparatus DA6 in the sixth embodiment, has a difference that a pair of seals 32 is replaced with a pair of seals 38, which have the following structure respectively. Other items are the same in both embodiments. Each of the sealing members 38 is divided into two types of sealing members 39 and 40, which are consecutively located in the rotating direction of the developer holder 3. The elasticities of the sealing members 39 and 40 are different from each other. The elasticity of each of the sealing members 39 and 40 is set so the elasticity of the sealing member 39 positioned at the upstream side in the feeding direction of the developer holder 3 is stronger than the elasticity of the downstream sealing member 40 positioned at the downstream side. The upstream sealing member 39 is in contact with the face of the developer holder 3 and the downstream sealing member 40 is in contact with both the face of the developer holder 3 and the back side of the layer thickness control member 31. For example, the upstream sealing member 39 is composed of solid-like rubber of 40° in hardness and the downstream sealing member 40 is composed of urethane sponge of 10° in hardness, and both members 39 and 40 are bonded into one piece or they are put in the developer case 4 so as to be in contact closely with each other. Other items such as configuration and disposition of the sealing members 38 are the same as those of the sealing members 32 in the sixth embodiment.

Consequently, the developer D moving due to the rotation of the developer holder 3 is initially restricted by the upstream sealing member 39 with stronger elasticity in the longitudinal direction of the developer holder 3. Then the developer D that cannot be restricted by the upstream sealing member 39 is wiped off by the downstream sealing member 40.

Since sealing members 38 whose elasticity is different from each other along the feeding direction of the developer holder 3 are used, one of the sealing members 39 restricts the developer D with its elastic portion, and the other sealing member 40 wipes off the developer D that cannot be restricted by the former one with its elastic portion. Thus, a surplus supply of the developer D to both ends of the developer holder 3 can be suppressed more effectively.

When the less elasticity downstream sealing member 40 is composed of the fiber sealing member, the developer D can be wiped more effectively.

Figure 15:
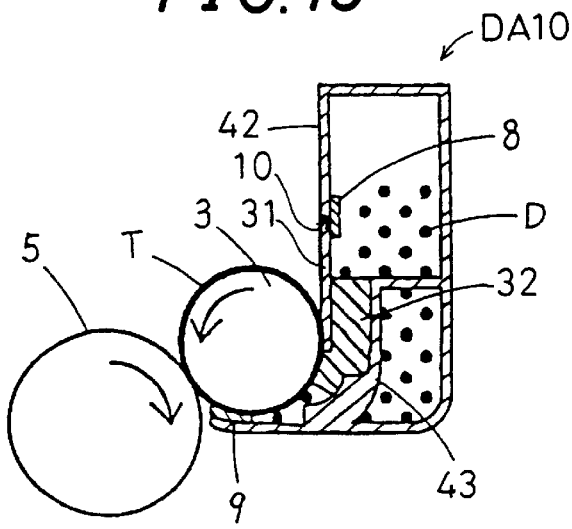
FIG. 15 is a schematic vertical cross sectional view of a developing apparatus DA10 in a tenth embodiment of the present invention.

FIG. 15 is a vertical cross sectional view of the developing apparatus DA10 in the tenth embodiment. The developing apparatus DA10, when compared with the developing apparatus DA6 in the sixth embodiment, has a difference that the developer case 4 in the DA6 is replaced with a developer case 42, which has the following structure. Other items are the same in both embodiments.

In the developing apparatus DA10 in this embodiment, the pressure with which the sealing member 32 is pressed against the developer holder 3 is set differently from the pressure with which the sealing member 32 is pressed against the layer thickness control member 31. This is because the pressure with which the sealing member 32 is pressed against the developer holder 3 should be set large in order to prevent the movement of the developer D to both ends of the developer holder 3 from being restricted. In this case, however, the pressure with which the sealing member 32 is pressed against the layer thickness control member 31 is also increased, so that the layer thickness control member 31 is deformed to change the contact condition on which the layer thickness control member 31 comes in contact with the developer holder 3 at a position close to the sealing member 32. As a result, the thin developer layer T goes unstable in thickness, disturbs the images printed out onto the laser printer, and causes damage to the developer holder 3 and the layer thickness control member 31.

When the pressure with which the sealing member 32 is pressed against the layer thickness control member 31 is reduced to prevent such problems as disturbed images and damage in the developer holder 3 and the layer thickness control member 31, the pressure with which the sealing member 32 is pressed against the developer holder 3 is also reduced. As a result, it becomes difficult to restrict the migration of the developer D toward both ends of the developer holder 3 and accordingly, the developer D scatters. To avoid such problems, it is only needed to change the pressure onto the sealing member 32 at plural points differently from each other, so that the sealing member 32 is properly pressed against the developer holder 3 and the layer thickness control member 31. The above is the reason why the projections 43 in the developer holder 42, which hold the sealing members 32 are shaped to be thick where the sealing members 32 are in contact with the surface of the developer holder 3 and to be thin where the sealing members are in contact with the layer thickness control member 31. For example, when each sealing member 32 is composed of urethane sponge of 20° in hardness and 6 mm in thickness, the compression of the sponge is 50% of the thickness when in contact with the surface of the developer holder 3 and 77% of the thickness when in contact with the layer thickness control member 31. Consequently, the pressure with which the sealing member 32 is pressed against the developer holder 3 is set larger than the pressure with which the sealing member 32 is pressed against the layer thickness control member 31. Other configuration and positioning items of the developer case 42 in the tenth embodiment are the same as those of the developer case 4 in the sixth embodiment.

The sealing members 32 are thus pressed against the developer holder 3 with a large force, so that a surplus supply of the developer D to the developer holder 3 is suppressed, and the movement of the developer D toward both ends of the developer holder 3 is stopped. On the other hand, since the sealing members 32 are pressed against the layer thickness control member 31 with a small force, the layer thickness control member 31 is prevented from deformation, so that the contact condition in which the layer thickness control member 31 comes in contact with the developer holder 3 at a position close to the sealing members 32 is not changed. The thin developer layer T is thus fixed, resulting in the printing out stable images and preventing generation of disturbed images. In addition, the developer holder 3 and the layer thickness control member 31 are protected from damage.

Hereafter, the developing apparatuses DA11 to DA13 in the eleventh to thirteenth embodiments will be described. In the developing apparatuses DA11 to DA13, the force with which the sealing members 45 are pressed against the developer holder 3 is set differently from the force with which the sealing members 45 are pressed against the layer thickness control member 31 as described in the tenth embodiment.

Figure 16:
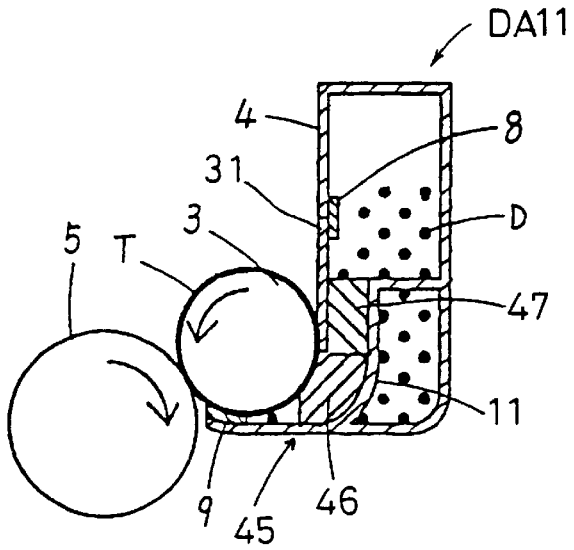
FIG. 16 is a schematic vertical cross sectional view of a developing apparatus DA11 in an eleventh embodiment of the present invention.

As shown in FIG. 16, the developing apparatus DA11 in the eleventh embodiment, when compared with the developing apparatus DA6 in the sixth embodiment, has a difference that a pair of sealing members 32 in the DA6 is replaced with a pair of sealing members 45, which have the following structure respectively. Other items are the same in both embodiments.

Each of the pair of sealing members 45 is divided into a high pressure sealing member 46 and a low pressure sealing member 47. The high pressure sealing member 46 comes in contact with the face of the developer holder 3 and the low pressure sealing member 47 comes in contact with the back of the layer thickness control member 31. The high pressure sealing member 46 is composed of solid-like rubber of 40° in hardness and the low pressure sealing member 47 is composed of urethane sponge of 10° in hardness. The pressure applied onto the high pressure sealing member 46 is set larger than that onto the low pressure sealing member 47.

Consequently, the high pressure sealing member 46 is pressed against the developer holder 3 by a strong force to suppress a surplus supply of the developer D to the developer holder 3. On the other hand, the low pressure sealing member 47 is pressed against the layer thickness control member 31 by a weak force to prevent the layer thickness control member 31 from deformation, so that generation of disturbed images is suppressed. Additionally, the developer holder 3 and the layer thickness control member 31 are protected from damage.

The developing apparatus DA12 in the twelfth embodiment, when compared with the developing apparatus DA6 in the sixth embodiment, has a difference that a pair of sealing members 32 in the DA6 is replaced with a pair of sealing members 49, which have the following structure, respectively. Other items are the same in both embodiments.

Figure 17:
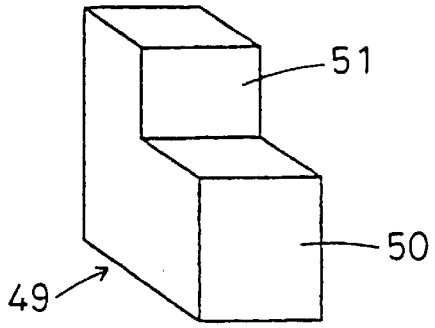
FIG. 17 is a schematic perspective view of a seal 49 used in a developing apparatus DA12 in a twelfth embodiment of the present invention.
Figure 18:
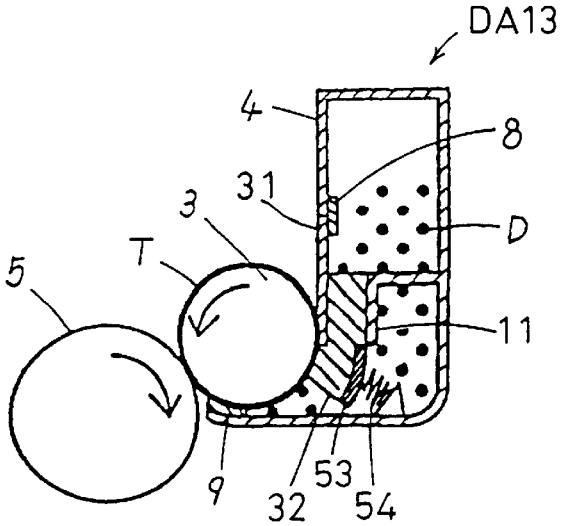
FIG. 18 is a schematic vertical cross sectional view of a developing apparatus DA13 in a thirteenth embodiment of the present invention.

The compressibility in the sealing member 49 is changed to optimize the pressing force. For example, as shown in FIG. 17, each sealing member 49 is composed of urethane sponge of 20° in hardness and step shaped, so that the sealing member 49 is thicker in an area 50 where the sealing member 49 comes in contact with the developer holder 3 than in an area 51 where the sealing member 49 comes in contact with the layer thickness control member 31. When the sealing members 49 are held by the projections 11 in the developer case 4, the sealing members 49 are compressed and fixed in thickness as shown in FIG. 8. The thickness of the sealing member 49 is set, for example, so that the compression is 50% of the thickness for the area 50 where the sealing member 49 contacts the face of the developer holder 3 and the compression is 77% of the thickness for the area 51 where the sealing member 49 contacts the back of the layer thickness control member 31. The projections 11 in the developer case 4 should be shaped as a step, so that the sealing members 49, when compressed, are fixed in thickness respectively.

Consequently, the sealing members 49 are pressed against the developer holder 3 by a strong force to suppress a surplus supply of the developer D to the developer holder 3. On the other hand, the sealing members 49 are pressed against the layer thickness control member 31 by a small force to prevent the layer thickness control member 31 from deformation, thus suppressing generation of disturbed images, as well as protecting the developer holder 3 and the layer thickness control member 31 from damage. In addition, since each of the sealing members 49 is not divided, it has no joints. Thus, the sealing properties for the developer D is improved significantly by preventing developer leaks.

The developing apparatus DA13 in the thirteenth embodiment, when compared with the developing apparatus DA6 in the sixth embodiment, has differences in that contact members 53 and pressing members 54 are added and each projection 11 in the developer case 4 has a notch. Other items are the same in both embodiments. In the developing apparatus DA13, contact members 53 that are freely movable and are in contact with the back of the sealing members 32 provided in the sixth embodiment, which contact the face of the developer holder 3. Each contact member 53 is pressed by a coil spring or a plate spring composed of the pressing member 54. In this way can force for pressing the sealing members 32 against the developer holder 3 may be increased.

FIG. 19 is a side view of the major portion of a developing apparatus DA14 in the fourteenth embodiment. The developing apparatus DA14 in the fourteenth embodiment, when compared with the developing apparatus DA6 in the sixth embodiment, has a difference that a pair of sealing members 32 in the DA6 is replaced with a pair of sealing members 56, which have the following structure respectively. Other items are the same in both embodiments.

Each sealing member 56 is notched at the upstream side end of the inner edge 56*a* to form an inclined plane 57. Consequently, the movement of the developer D fed on the developer holder 3 is restricted by the sealing members 56 in the longitudinal direction, but the developer D that cannot be restricted is guided by the inclined plane 57 of each sealing member 56 to the inner portion in the longitudinal direction of the developer holder 3. The movement of the developer D to both ends of the developer holder 3 is thus surely suppressed to prevent a surplus supply of the developer D there.

It is also possible to obtain the same effect by inclining each sealing member 32 in the sixth embodiment so that the interval between the sealing members 32 is narrowed from the upstream to the downstream in the developer feeding direction.

Figure 20:
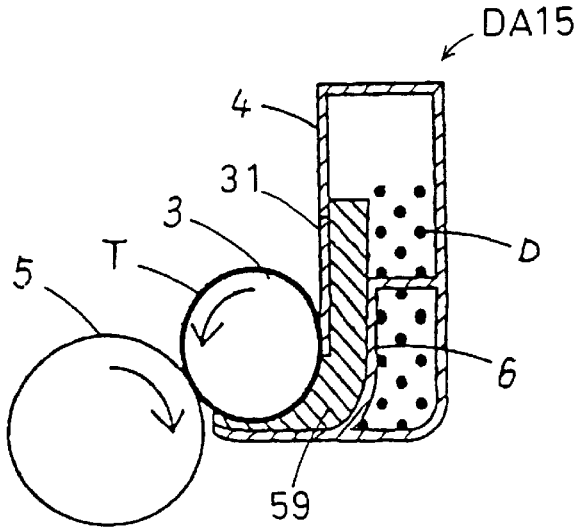
FIG. 20 is a schematic vertical cross sectional view of a developing apparatus DA15 in a fifteenth embodiment of the present invention.

FIG. 20 is a cross sectional view of a developing apparatus DA15 in the fifteenth embodiment. The developing apparatus DA15 in the fifteenth embodiment, when compared with the developing apparatus DA6 in the sixth embodiment, has differences that a pair of sealing members 32, and both upper and lower sealing members 8 and 9 in the DA6, are replaced with a sealing member 59, which has the following structure. Other items are the same in both embodiments.

The sealing member 59 is disposed between the developer holder 3 and the developer case 4 to prevent leaks of the developer D from the developer case 4. In other words, one end of the sealing member 59 covers a portion where the developer case 4 is fixed to the layer thickness control member 31 and the other end covers the gap between the developer holder 3 and the opening 6 of the developer case 4. Consequently, the sealing member 59 is structured to unite the upper sealing member 8 between the layer thickness control member 31 and the developer case 4 with the lower sealing member 9 between the developer holder 3 and the developer case 4. The other configuration items of the sealing member 59 are the same as those of the sealing member 32 in the sixth embodiment.

Consequently, the sealing member 59 functions to restrict the movement of the developer D to both ends of the developer holder 3 and also functions to seal the developer case 4. Thus, leaks of the developer D from the developer case 4, caused by vibration, impact, etc. during transportation, is prevented without the presence of upper and lower sealing members 8 and 9. Since the sealing member 32 is united with the upper and lower sealing members 8 and 9 in such a way, the sealing members 8 and 9 are omitted and the gap between the developer case 4 and another item is sealed with a simple structured sealing member.

Figure 21:
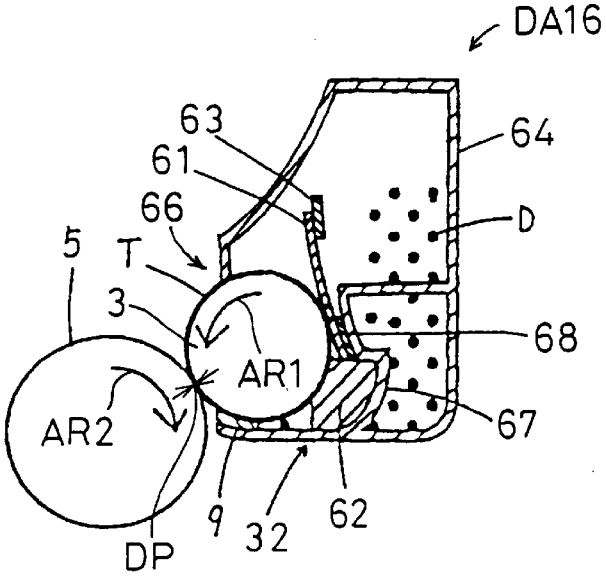
FIG. 21 is a schematic vertical cross sectional view of a developing apparatus DA16 in a sixteenth embodiment of the present invention.
Figure 22:
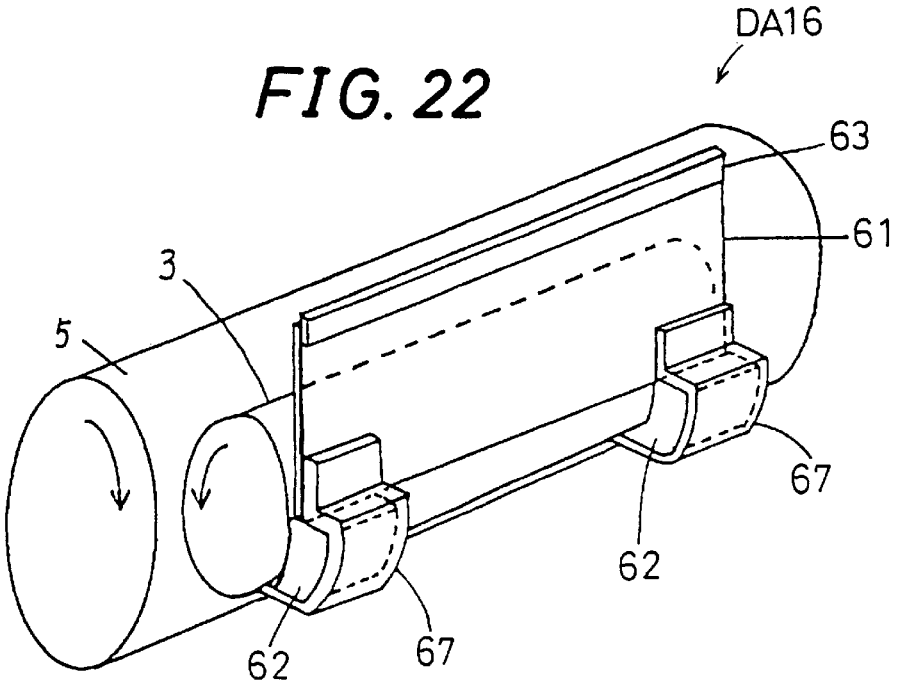
FIG. 22 is a perspective view of the major portion of the developing apparatus DA16 in the sixteenth embodiment of the present invention.
Figure 23:
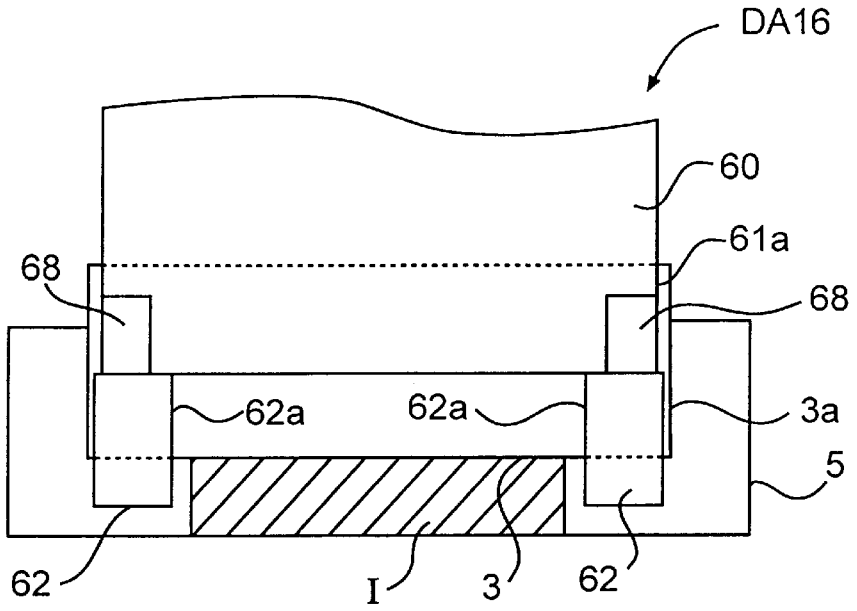
FIG. 23 is a side view of the major portion of the developing apparatus DA16 in the sixteenth embodiment of the present invention.

FIG. 21 is a schematic vertical cross sectional view of a structure of a developing apparatus DA16 of the sixteenth embodiment of the present invention. FIGS. 22 and 23 are a perspective view and a side view of the major portion of the developing apparatus DA16. Hereafter, the schematic configuration of the developing apparatuses DA16 will be described with reference to FIGS. 21 to 23. The developing apparatus DA16 includes some parts having the same structures and the same functions as those of the developing apparatuses DA1 and DA6 in the first and sixth embodiments. Thus, the same reference numerals will be given to those parts.

The developing apparatus DA16 includes a developer holder 3, a layer thickness control member 61, sealing members 62, fixing plates 63, a developer case 64, and a lower sealing member 9. The developer case 64, when compared with the developer case 4, has differences that the shapes around an opening 66 and projections 67 are different from those of the developer case 4. Other items are the same. The layer thickness control member 61 slidably contacts the face of the developer holder 3 to form a developer layer T at a specified thickness. The sealing members 62 contact the developer holder 3 to restrict the movement of the developer D on the developer holder 3 in the longitudinal direction.

The layer thickness control member 61 allows one end to be fixed to the developer case 64 via the fixing plates 63 all along the longitudinal direction of the developer holder 3. At the leading edge on the back of the layer thickness control member 61, which is not in contact with the developer holder 3, both ends of the layer thickness control member 61 in the longitudinal direction are bonded to the projections 67 in the developer case 64 using a bonding material 68.

The bonding material 68 is an epoxy or acrylic resin instant adhesive. When such an adhesive is used, problems occur when during coating work; the adhesive sticks on other portions, for example, on the developer holder 3 or the adhesive, which after being coated, flows onto other portions and is cured there. To avoid such problems, an adhesive tape that has an adhesive on both sides, that is, a so-called double-sided adhesive tape, should be used. Use of such a double-sided adhesive tape will also improve the workability. Thereby, there is no trouble from flowing of the adhesive. At first, the double-sided adhesive tape is stuck on the layer thickness control member 61, then the other adhesive side of the member 61 is stuck on the developer case 4. This will not only eliminate the above problems, but also improve the work yield rate to be more than when an adhesive is used.

This layer thickness control member 61 is composed of, for example, a stainless steel plate of 0.1 mm in thickness and the width of the member 61 in the longitudinal direction is set less than that of the developer holder 3. The leading edge on the face or a portion around the leading edge is in contact with the developer holder 3 all along the longitudinal direction. The distance between the portion where the layer thickness control member 61 is fixed to the developer case 64 and the portion where the member 61 is in contact with the developer holder 3 is 10 mm and the deflection is 1 mm. Since the layer thickness control layer 61 is pressed against the developer holder 3 is uniform by its own elastic force, both the thickness and charge level of the thin developer layer T are stabilized. The layer thickness control member 61 may be equal to or greater in width than the developer holder 3.

The sealing members 62 are disposed at the upstream side of the layer thickness control member 61 and around both ends of the developer holder 3 respectively so that they contact the leading edge of the layer thickness control member 61 without being overlapped thereon. Each sealing member 62 is held at its back by the projection 67 in the developer case 64. The pair of sealing members 62 are separated from each other so that the inner edge 62*a* of each sealing member 62 is positioned between a side edge 3*a* of the developer holder 3 and an extended line of a side edge of the image area I on the image holder 5. Other configuration items of the developing apparatus DA16 may be the same as those in each of the above embodiments. Furthermore, the structure of each sealing member 62 may be the same as any of those in other embodiments described above to obtain the same effect.

In this sixteenth embodiment, both edges 61*a* of the layer thickness control member 61 contact the face of the developer holder 3 directly, but they are not pressed by the sealing members 62 against the developer holder 3. Thus, local damages caused by such the forced contact between the developer holder 3 and both edges 61*a* of the layer thickness control member 61 are prevented, so that excessive supply of the developer D to both ends of the developer holder 3 is suppressed.

Hereafter, explanation will be made of the procedure for developing an electrostatic latent image on the image holder 5 using the developing apparatus DA16. When the developer D is properly supplied from the developer case 64 gradually onto the face of the developer holder 3 rotating in the direction of the arrow AR2, the sealing members 62 restrict the movement of the developer D, so that a surplus supply of the developer D to both ends of the developer holder 3 is suppressed.

The thickness of the developer D supplied to a portion between both the sealing members 62 on the peripheral surface of the developer holder 3 is restricted by the layer thickness control member 61, so that a thin developer layer T is formed on the developer holder 3. Consequently, the developer D is charged by frictional electrification sufficient for development. This thin developer layer T is transferred according to the rotation of the developer holder 3 up to the developing position DP where the image holder 5 is in contact or almost in contact with the developer holder 3 to be used for development. At this time, at the leading edge of the layer thickness control member 61, the face of the member 61 is pressed against the developer holder 3 and the back of both ends of the member 61 is in contact with the developer case 4. Thus, there is no gap generated around the leading edge of the layer thickness control member 61, and no developer D leaks there.

Since an adhesive or an adhesive tape functions as a sealing member, the adhesive or adhesive tape, used together with the pair of sealing members 62 can suppress the movement of the developer D to both ends of the developer holder 3, which are non-image areas. No surplus developer D is thus supplied to both ends of the developer holder 3, and therefore no problem arises from the scattering of developer D that is not used for development. Accordingly, the developing apparatus is protected from contamination by the scattering of the developer in the apparatus, as well as unnecessary consumption of the developer D is prevented.

It is also possible to obtain the same sealing effect for the developer D by letting the sealing members 62 contact the layer thickness control member 61 so as to be overlapped thereon so that the back of the layer thickness control member 61 contacts with the sealing members 62 directly.

Figure 24:
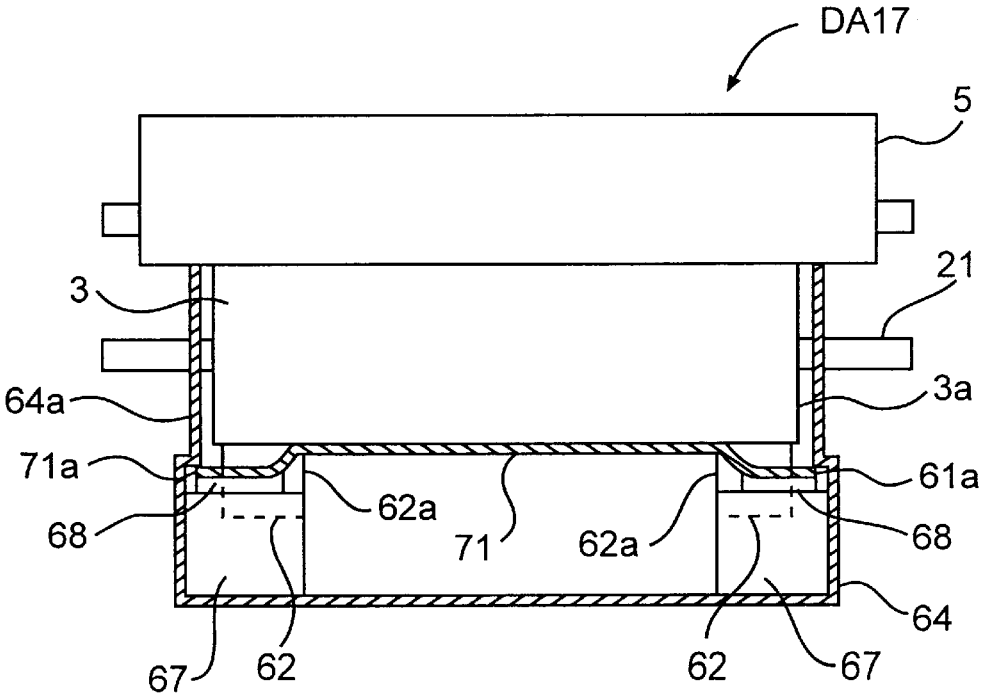
FIG. 24 is a top view of the major portion of a developing apparatus DA17 in a seventeenth embodiment of the present invention.
Figure 25A:
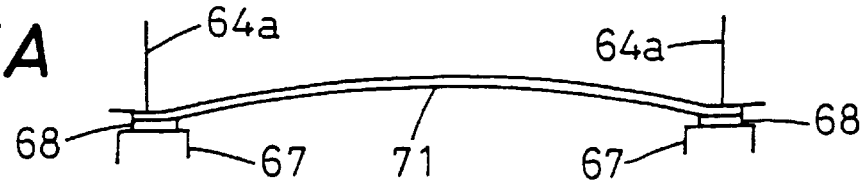
FIG. 25A and FIG. 25B illustrate shapes of a layer thickness control member 71 before and after the developer holder 3 is provided in the developing apparatus DA17 in the seventeenth embodiment.
Figure 25B:
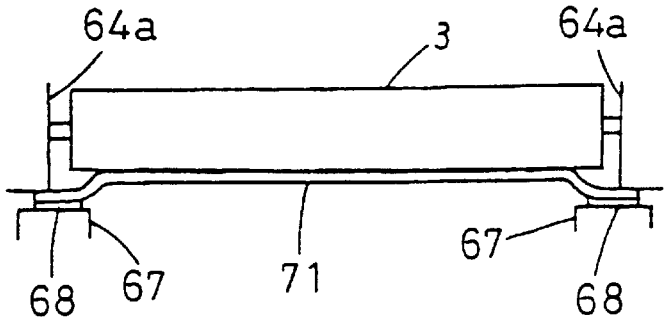
Figure 26:
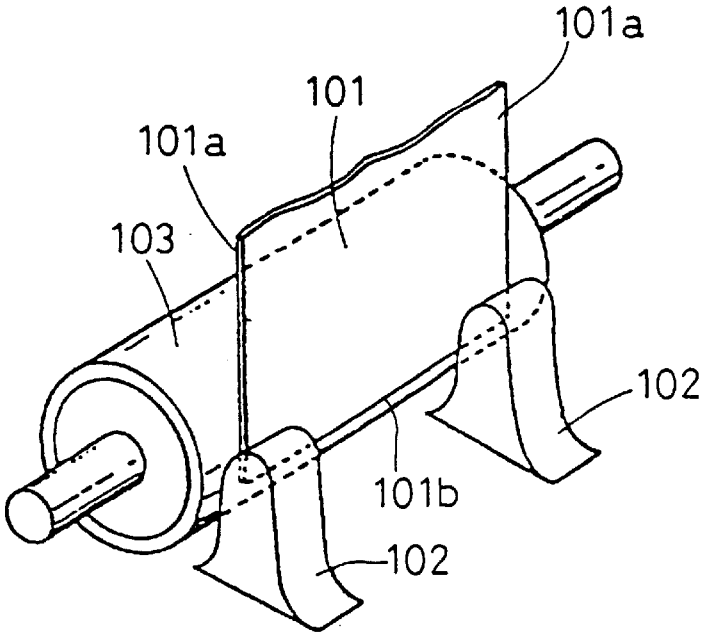
FIG. 26 PRIOR ART
FIG. 26 is a perspective view of the major portion of a prior art developing apparatus disclosed in Japanese Unexamined Patent Publication JP-A 4-62391 (1992).
Figure 27:
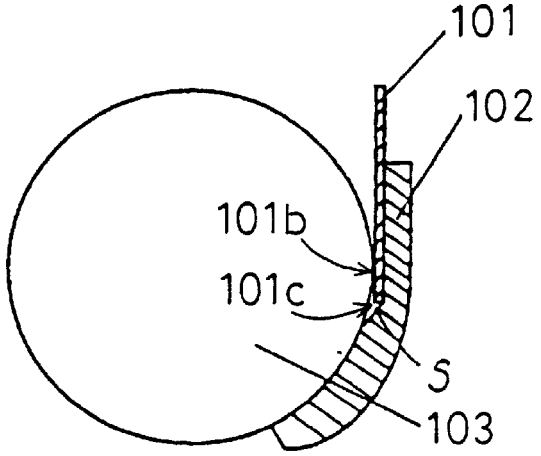
FIG. 27 PRIOR ART
FIG. 27 is a cross sectional view of a prior art developing apparatus disclosed in Japanese Unexamined Patent Publication JP-A 4-62391 (1992).
Figure 28:
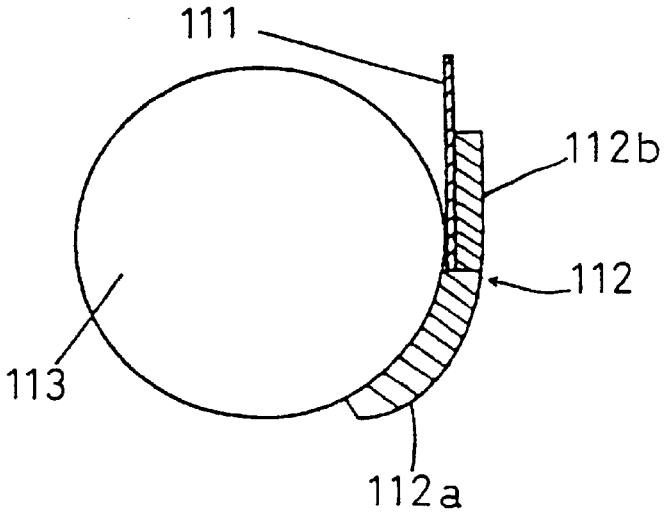
FIG. 28 PRIOR ART
FIG. 28 is a cross sectional view of the major portion of a prior art developing apparatus disclosed in Japanese Unexamined Patent Publication JP-A 4-249273 (1992).

Hereafter, the developing apparatus DA17 in the seventeenth embodiment will be described with reference to FIGS. 24, 25A, and 25B. The developing apparatus DA17, when compared with the developing apparatus DA16 in the sixteenth embodiment, has a difference in that the layer thickness control member 61 in the DA16 is replaced with a layer thickness control member 71. Other items are the same in both embodiments. The developing apparatuses DA17 includes some parts having the same structures and the same functions as those of the developing apparatus DA16 in the sixteenth embodiment. Thus, the same reference numerals will be given to those parts and the explanation will be omitted, avoiding redundant explanation.

In the seventeenth embodiment, the layer thickness control member 71 is arched toward the developer holder 3 in the center portion in the longitudinal direction of the developer holder 3. Similar to the layer thickness control member 61 in the sixteenth embodiment, one end of the member 71 is fixed to the developer case 64. Both ends of the leading edge of the member 71 are also fixedly bonded to the projections 67 in the developer case 64. Both ends of the leading edge of the member 71 are separated from the developer holder 3 and the receiving members 64*a* of the developer case 64. However, the developer holder 3 is contact with the face of the member 71. The receiving members 64*a* support the developer holder 3. In other words, when the developer holder 3 is not present, the center portion in the longitudinal direction is arched toward the outside of the developer case 64 as shown in FIG. 25A. When the developer holder 3 exists, the layer thickness control member 71 is in contact with the face of the developer holder 3, as shown in FIG. 25B. Other configuration items are the same as that the sealing member 62 in the sixteenth embodiment.

Consequently, the contact area between the layer thickness control member 71 and the developer holder 3 is increased, so that the layer thickness control member 71 can be equally pressed against the developer holder 3 over a wide range. In this case, however, it is only required that the area where the layer thickness control member 71 contacts the developer holder 3 should be at least larger than the image area I of the image holder 5, and each side edge 71*a* should be outside the inner edge 62*a* of each sealing member 62.

Consequently, even when the developer D whose movement is restricted by the layer thickness control member 71 moves to both ends of the developer holder 3 along the back of the layer thickness control member 71, the developer D cannot reach there, since the adhesive material 68 seals the portion between the developer holder 3 and the developer case 64. The layer thickness control member 71 having such a structure and the sealing members 62 can thus prevent a surplus supply of the developer D to both ends of the developer holder 3. The developer D that is not used for development is not scattered, thereby protecting the developing apparatus from contamination by the scattering of the developer D and suppressing unnecessary consumption of the developer D.

In the developing apparatuses DA16 and DA17 in the sixteenth and seventeenth embodiments, both ends of the layer thickness control member 61,71 are attached to the developer case 4 and the control member 61,71, for example, is arched to be pressed against the developer holder 3. In this case, because of the deflection of the outer shape of the developer holder 3 or the roughness of the adhesive face of the developer case 64, as well as because of variation of the mounting accuracy, both ends of the layer thickness control member 61,71 do not contact the developer holder 3. In order to stabilize the thickness of the developer layer T, the layer thickness control member 61,71 must therefore be pressed strongly against the developer holder 3 so as to contact the developer holder 3.

When the external shape of the developer holder 3 is set so that the adhesive surface of the layer thickness control member 61,71 is maximized, the layer thickness control member 61,71 will bite deepest into the developer holder 3, and the friction generated between the layer thickness control member 61,71 and the developer holder 3 is significantly increased. As a result, the rotation torque increases to load the driving source, i.e., motor, of the developer holder 3.

In order to protect the developer holder 3 from such variation of mounting accuracy, the hardness of the developer holder 3, which is composed of soft rubber materials such as urethane rubber or nitrile rubber (NBR), becomes a very important item. Preferably, the hardness of the developer holder 3 should preferably be 65° or under when measured with an Asker C (a rubber hardness meter of Koubunshi Keiki Co., Ltd. Conforming to Japan Rubber Association Standard SRIS 0101). This hardness is equivalent to 40° or under in the hardness conforming to JIS K6301, and equivalent to about 26° or under in the hardness conforming to ASTM D2240. The lower limit of the hardness is not specified as long as a soft rubber material is used.

Since the hardness of the developer holder 3 is set lower than the specified value, when the layer thickness control member 61,71 bites deeply into the developer holder 3, an elastic deformation is apt to occur in the layer thickness control member 61,71 on the face of the developer holder 3. Thus, the friction generated between the layer thickness control member 61,71 and the developer holder 3 is not increased, and the rotation torque is therefore not increased by frictional resistance. This is why the driving source of the developer holder 3 is not loaded, and the driving torque can be reduced. The torque of the whole image forming apparatus including the developing apparatus DA16,DA17 provided with the layer thickness control member 61,71 can thus be reduced, enabling a less expensive motor to be used as the driving source of the developer holder 3.

To confirm the effect of the developer holder 3 concerning the hardness of the material, the rotation torque measuring test was performed using a conductive urethane rubber roller as the developer holder 3 in the developing apparatus DA6 in the sixth embodiment. In the test, the hardness of the urethane rubber was changed within 50° to 75° (Asker C Standard). Table 1 shows the test results. The layer thickness control member 31 is composed of a stainless steel plate of 0.1 mm in thickness. One end of the layer thickness control member 31 is fixed to the developer case 4. The layer thickness control member 31 is pressed against the developer holder 3 by the elastic force of the layer thickness control member 31 itself. The distance between the portion where the layer thickness control member 31 is fixed to the developer case 4 and a portion where the control member 31 is in contact with the developer holder 3 is 10 mm and the deflection is 1 mm.

As understood from the Table 1, as the rubber hardness is increased, the rotation torque of the developer holder 3 is also increased. When the rubber hardness is 65° or over, it is found that the rotation torque is increased sharply. Even when both ends of the layer thickness control member 61,71 is bonded to the developer case 4 as seen in the developing apparatuses DA16 and DA17 in the sixteenth and seventeenth embodiments, the layer thickness control member 61,71 is pressed against the developer holder 3 by as much elastic force as ever. Thus, the test results are true. From the test results shown in the Table 1, it is understood that the hardness of the developer holder 3 should be preferably 65° or under when in conforming to the Asker C Standard. In the developing apparatuses DA1 to DA15 in the first to fifteenth embodiments, the hardness of the developer holder 3 should be preferably 65° or under when conforming to the Asker C Standard.

TABLE 1

| Roller Rubber Hardness (Asker C) | Developer Holder Rotating Torque (kgf · cm) |
|---|---|
| 50 | 0.15 |
| 55 | 0.20 |
| 60 | 0.24 |
| 65 | 0.43 |
| 70 | 0.65 |
| 75 | 0.98 |

Another method for being free from scattering of mounting accuracy, etc. described above is reduce the hardness at both ends of the peripheral surface of the developer holder 3 in the longitudinal direction to be less than the hardness in the center portion of the peripheral surface of the developer holder 3. More specifically, one type of soft rubber material is used for the developer holder 3 so that the hardness is reduced gradually from center to end portion (inclined characteristics). Otherwise, the developer holder 3 should be composed of a laminate obtained by bonding plural soft rubber materials, each of which has a hardness different from others. In the latter case, the soft rubber materials should be bonded outside the image area I of the image holder 5, so that even when a the developer layer T is formed on the developer holder 3, images are not affected by a scattering of hardness and joints of those materials for the reasons described below.

In other words, since both ends of the layer thickness control member 61,71 are most affected by a scattering of mounting accuracy, etc., those portions of the control member 61,71 bite into the developer holder 3, so that the frictional resistance is increased more than in the center portion. This is why the hardness at both ends of the layer thickness control member 61,71 is lower than in the center portion. Therefore, the friction is reduced even when both ends of the layer thickness control member 61,71 bite into the developer holder 3 to prevent the rotational torque from increasing. Furthermore, a certain hardness exists in the center portion, so the contact state between the layer thickness control member 61,71 and the developer holder 3 can be properly kept and the control member 61,71 is pressed evenly against the developer holder 3 to stabilize the thickness of the developer layer T.

The invention is not limited only to the embodiments described above. The embodiments may be modified and varied freely. For example, in the sixth to seventeenth embodiments, it is only required that the inner edge of each sealing member is positioned between the side edge of the developer holder and the side edge of the image area. The outer edge of the sealing member may also be positioned at or outside the side edge of the developer holder so that the sealing members cover both ends of the developer holder.

Furthermore, one end of each sealing member can be engaged with a supporting right-hand or left-hand threaded rod and the supporting rod is rotated by the motor etc., to move each sealing member in the opposite direction of the other one. Consequently, the interval of the pair of sealing members can be varied according to the width of each electrostatic latent image formed on the image holder, so that supply of surplus developer to the developer holder can be suppressed more effectively. Furthermore, the improvements described in the case of the developing apparatuses DA1 to DA17 in the first to seventeenth embodiments may be combined as needed properly to apply the result to a single developing apparatus.

The invention may be embodied in other specific forms without departing from the spirit or essential characteristics thereof. The present embodiments are therefore to be considered in all respects as illustrative and not restrictive. The scope of the invention is being indicated by the appended claims rather than by the foregoing description, and all changes which come within the meaning and the range of equivalency of the claims are therefore intended to be embraced therein.

What is claimed is:

1. A developing apparatus for developing images held on an image holder, comprising:

a developer holder for feeding a developer to a developing position facing the image holder;

a layer thickness control member for slidably contacting a face of the developer holder and forming a developer layer having a predetermined thickness on the developer holder; and elastic seals for contacting both the layer thickness control member and the developer holder and restricting a movement of the developer on the developer holder in a longitudinal direction orthogonal to a feeding direction of the developer;

wherein a width of the layer thickness control member in the longitudinal direction is wider than a width of the developer holder in the longitudinal direction and the seals have side edges where at least one side edge of each seal is inside the corresponding edge of the developer holder to form inner side edges: and wherein the inner side edges of the seals are aligned to side edges of a predetermined image area on the image holder.

2. The developing apparatus of claim 1, further comprising a developing tank which houses the developer, the developer holder, the layer thickness control member, and the seals, and is provided with an opening formed at a portion facing the image holder, wherein part of each seal is disposed between the developer holder and a seal supporting portion provided on an inner wall of the developing tank.

3. The developing apparatus of claim 1, wherein each of the seals is pressed against the developer holder with greater force than a force with which it is pressed against the layer thickness control member.

4. The developing apparatus of claim 3, wherein each of the seals is composed of a plurality of elastic sealing members, each of which is compressed with a pressure different from the others.

5. The developing apparatus of claim 3, wherein each of the seals is composed of an elastic material; and each of the seals is shaped differently at a portion where it is in contact with the layer thickness control member so that the pressure with which the seal contacts the developer holder is different than the pressure with which the seal contacts the layer thickness control member.

6. The developing apparatus of claim 1, wherein the inner side edges of each of the seals are inclined to guide the developer on the developer holder toward the axial center of the developer holder.

7. The developing apparatus of claim 1, wherein there is only one layer thickness control member.

8. A developing apparatus for developing images held on an image holder, comprising:

a developer holder for feeding the developer to a developing position facing an image holder;

a layer thickness control member having a face having a leading edge for slidably contacting a face of the developer holder at the leading edge and forming a developer layer having a predetermined thickness on the developer holder; and a pair of elastic seals being in contact with both the leading edge of the layer thickness control member and the developer holder to restrict a movement of the developer in the axial line direction to both ends of the developer holder orthogonal to a feeding direction of the developer, wherein both side edges of the layer thickness control member are disposed at the same positions as side edges of the developer holder, or beyond the side edges of the developer holder, the pair of seals are disposed at an interval equal to or a little wider than the width of the predetermined image area on the image holder, and each inner side edge of the seals is disposed inside the corresponding side edge of the developer holder, wherein each of the seals in the developing apparatus is composed of a plurality of sealing members, each of which has an elasticity different from the others.

9. The developing apparatus of claim 8, wherein large elasticity sealing members of the plurality of sealing members are disposed inside small elasticity sealing members of the plurality of sealing members in the axial line direction.

10. The developing apparatus of claim 8, wherein the plurality of sealing members comprise a large elasticity sealing member and a low elasticity sealing member, so that the large elasticity sealing member is disposed at the upstream side of the low elasticity sealing member in the feeding direction of the developer, so that the large elasticity sealing member is in contact with the developer holder and the low elasticity sealing member is in contact with the layer thickness control member.

11. A developing apparatus for developing images held on an image holder comprising:

a developer holder for feeding a developer to a developing position facing the image holder;

a layer thickness control member for slidably contacting a face of the developer holder and forming a developer layer having a predetermined thickness on the developer holder;

seals being in contact with the developer holder to restrict a movement of the developer on the developer holder in an axial line direction orthogonal to a feeding direction of the developer; and a developing tank housing the developer, the developer holder, the layer thickness control member and the seals, wherein a back side of the layer thickness control member is bonded to an internal surface of the developing tank at axial edges of a leading edge portion of the layer thickness control member.

12. The developing apparatus of claim 11, wherein the layer thickness control member is bonded to the developing tank using a double-sided adhesive tape.

13. The developing apparatus of claim 11, wherein the developer holder has two ends and a center, wherein a hardness of the developer holder is lower at both ends than in the center of the developer holder and the layer thickness control member is pressed against the developer holder.

14. The developing apparatus of claim 11, wherein the developer holder has an Asker C hardness of 40° or less, and the layer thickness control member is pressed against the developer holder.

15. The developing apparatus of claim 12, wherein the layer thickness control member is arched such that the layer thickness control member does not contact the developer holder at either end of the layer thickness control member.

16. The developing apparatus of claim 11, wherein there is only one layer thickness control member.

17. A developing apparatus for developing images held on an image holder, comprising:

a developer holder for holding a developer and feeding the developer to a developing position facing the image holder;

a layer thickness control member having a leading edge for slidably contacting a face of the developer holder, and forming a developer layer having a predetermined thickness on the developer holder;

elastic sealing members for restricting a movement of the developer to both ends of the developer holder, the elastic sealing members having outside and inside edges, wherein each of the elastic sealing members is composed of a large elasticity sealing member and a small elasticity sealing member, and wherein the large elasticity sealing members are disposed nearer the axial center of the developer holder than the small elasticity sealing members; and a back side elastic sealing member provided on the back of the layer thickness control member, the back side elastic sealing member being in contact with the inside edges of the elastic sealing members, wherein the developer is sealed by the back side elastic sealing member and the elastic sealing members.

18. The developing apparatus of claim 17, wherein the small elasticity sealing member comprises a fiber elastic member.

19. The developing apparatus of claim 17, wherein there is only one layer thickness control member.

20. A developing apparatus for developing images held on an image holder, comprising:

a developer holder for holding a developer and feeding the developer to a developing position facing the image holder;

a layer thickness control member having a leading edge for slidably contacting a face of the developer holder, and forming a developer layer having a predetermined thickness on the developer holder;

elastic sealing members for restricting a movement of the developer to both ends of the developer holder, the elastic sealing members having outside and inside edges, wherein each of the elastic sealing members is composed of a large elasticity sealing member and a small elasticity sealing member, and wherein the large elasticity sealing members are disposed upstream of the small elasticity sealing members with respect to a developer feeding direction; and a back side elastic sealing member provided on the back of the layer thickness control member, the back side elastic sealing member being in contact with the inside edges of the elastic sealing members, wherein the developer is sealed by the back side elastic sealing member and the elastic sealing members.

21. The developing apparatus of claim 20, wherein there is only one layer thickness control member.

22. A developing apparatus for developing images held on an image holder, comprising:

a developer holder for holding a developer and feeding the developer to a developing position facing the image holder;

a layer thickness control member having a leading edge for slidably contacting a face of the developer holder, and forming a developer layer having a predetermined thickness on the developer holder;

elastic sealing members for restricting a movement of the developer to both ends of the developer holder, the elastic sealing members having outside and inside edges; and a back side elastic sealing member provided on the back of the layer thickness control member, the back side elastic sealing member being in contact with the inside edges of the elastic sealing members, wherein the developer is sealed by the back side elastic sealing member and the elastic sealing members;

a developing tank housing the developer holder and the layer thickness control member, provided with an opening formed at a portion facing the image holder;

a first gap sealing member for sealing a gap between the layer thickness control member and an inner wall portion around the opening provided on the developing tank housing; and a second gap sealing member for sealing a gap between the developer holder and the inner wall portion around the opening provided on the developing tank housing, wherein the elastic sealing members are formed unitarily with at least on of the first and second gap sealing members.

23. The developing apparatus of claim 22, wherein there is only one layer thickness control member.

24. A developing apparatus for developing images held on an image holder, comprising:

a developer holder for holding a developer and feeding the developer to a developing position facing the image holder;

a layer thickness control member having a leading edge for slidably contacting a face of the developer holder, and forming a developer layer having a predetermined thickness on the developer holder;

elastic sealing members for restricting a movement of the developer to both ends of the developer holder, the elastic sealing members having outside and inside edges; and a back side elastic sealing member provided on the back of the layer thickness control member, the back side elastic sealing member being in contact with the inside edges of the elastic sealing members, wherein the back side elastic sealing member is smaller in hardness than the elastic sealing members, wherein the developer is sealed by the back side elastic sealing member and the elastic sealing members.

25. The developing apparatus of claim 24, wherein there is only one layer thickness control member.

* * * * *